US006920223B1

(12) United States Patent
Fosgate

(10) Patent No.: US 6,920,223 B1
(45) Date of Patent: Jul. 19, 2005

(54) METHOD FOR DERIVING AT LEAST THREE AUDIO SIGNALS FROM TWO INPUT AUDIO SIGNALS

(75) Inventor: James W. Fosgate, Heber City, UT (US)

(73) Assignee: Dolby Laboratories Licensing Corporation, San Francisco, CA (US)

( * ) Notice: Subject to any disclaimer, the term of this patent is extended or adjusted under 35 U.S.C. 154(b) by 0 days.

(21) Appl. No.: 09/532,711

(22) Filed: Mar. 22, 2000

Related U.S. Application Data

(63) Continuation-in-part of application No. 09/454,810, filed on Dec. 3, 1999.

(51) Int. Cl.[7] ..... H04R 5/00
(52) U.S. Cl. ..... 381/22; 381/19
(58) Field of Search ..... 381/19–23, 17, 381/18

(56) References Cited

U.S. PATENT DOCUMENTS

| | | | | |
|---|---|---|---|---|
| 4,589,129 | A | 5/1986 | Blackmer et al. | 381/21 |
| 4,799,260 | A | 1/1989 | Mandell et al. | 381/22 |
| 5,172,415 | A | 12/1992 | Fosgate | 381/22 |
| 5,295,189 | A | 3/1994 | Fosgate | 381/22 |
| 5,428,687 | A | 6/1995 | Willcocks et al. | 381/18 |
| 5,504,819 | A | 4/1996 | Fosgate | 381/18 |
| 5,625,696 | A | 4/1997 | Fosgate | 381/18 |
| 5,644,640 | A | 7/1997 | Fosgate | 381/18 |
| 5,862,228 | A | 1/1999 | Davis | 381/17 |

FOREIGN PATENT DOCUMENTS

| | | |
|---|---|---|
| EP | 0949845 | 10/1999 |
| JP | 10062460 | 3/1998 |

OTHER PUBLICATIONS

Texas Instruments Incorporated, TL07_Series Low–Noise JFET–Input Operational Amplifiers data sheet, 1996, Dallas, Texas.

Analog Devices, Inc., Dynamic Range Processors/Dual VCA SSM2120/SSM2122 data sheet, 1995, Norwoord, Massachusetts.

Gundry, Kenneth, "A New Active Matrix Decoder for Surround Sound", AES 19th International Conference on Surround Sound, Jun. 21, 2001, Schloss Elmau, Germany.

Texas Instruments Data Sheets: TL071, TL071A, TL071B, TL072, TL072A, TL072B, TL074, TL074A, TL074B Low–Noise JFET–Input Operational Amplifiers, Dallas, TX 1996.

Texas Instruments Data Sheets: Analog Devices—Dynamic Range Processors/Dual VCA SSM2120/SSM2122, Dallas, TX 1995.

2000, TL074, Quad Low–Noise JFET–Input General–Purpose Operational Amplifier, Texas Instruments Product Sheet published at website address www.ti.com/sc/docs/products/analog/t1074.html.

*Primary Examiner*—Ping Lee
(74) *Attorney, Agent, or Firm*—Gallagher & Lathrop; Thomas A. Gallagher

(57) ABSTRACT

Various equivalent adaptive audio matrix arrangements are disclosed, each of which includes a feedback-derived control system that automatically causes the cancellation of undesired matrix crosstalk components in the matrix output. Each adaptive audio matrix arrangement includes a passive matrix that produces a pair of passive matrix signals in response to two input signals. A feedback-derived control system operates on each pair of passive matrix signals, urging the magnitudes of pairs of intermediate signals toward equality. Each control system includes variable gain elements and a feedback and comparison arrangement generating a pair of control signals for controlling the variable gain elements. Additional control signals may be derived from the two pairs of control signals for use in obtaining more than four output signals from the adaptive matrix.

34 Claims, 26 Drawing Sheets

100K Input "Z"
Input Select
Input
Left_1
Right_1
Left_2
Right_2
J1 RCA
J2 RCA
J3 RCA
J4 RCA
SW1-1
SW1-2
4PDT
R1 36.5K
R2 2M
R3 49.9K
R4 49.9K
R13 365K
R16 2M
R19 49.9K
R20 49.9K
C2 .33
C3 82pF
C5 .33
C6 82pF
U1A TLO74
U1D TLO74
R38 15K
R68 15K
VR3 5K
VR5 5K
Right VCA Gain
Left VCA Gain
CW
D1 1N47368 6.8V
D2 1N47368 6.8V
R40 15K
R41 46.4K
C15 .022
R42 200K
R43 10K
R46 20K
R49 10K
R53 200K
U5A TLO74
U58 TLO74
LIN Correction
L/R Servo

METHOD FOR DERIVING AT LEAST THREE AUDIO SIGNALS FROM TWO INPUT AUDIO SIGNALS

CROSS-REFERENCE TO RELATED APPLICATION

This application is a continuation-in-part of U.S. patent application Ser. No. 09/454,810, filed Dec. 3, 1999.

FIELD OF THE INVENTION

The invention relates to audio signal processing. In particular, the invention relates to "multidirectional" (or "multichannel") audio decoding using an "adaptive" (or "active") audio matrix method that derives three or more audio signal streams (or "signals" or "channels") from a pair of audio input signal streams (or "signals" or "channels"). The invention is useful for recovering audio signals in which each signal is associated with a direction and was combined into a fewer number of signals by an encoding matrix. Although the invention is described in terms of such a deliberate matrix encoding, it should be understood that the invention need not be used with any particular matrix encoding and is also useful for generating pleasing directional effects from material originally recorded for two-channel reproduction.

BACKGROUND OF THE INVENTION

Audio matrix encoding and decoding is well known in the prior art. For example, in so-called "4-2-4" audio matrix encoding and decoding, four source signals, typically associated with four cardinal directions (such as, for example, left, center, right and surround or left front, right front, left back and right back) are amplitude-phase matrix encoded into two signals. The two signals are transmitted or stored and then decoded by an amplitude-phase matrix decoder in order to recover approximations of the original four source signals. The decoded signals are approximations because matrix decoders suffer the well-known disadvantage of crosstalk among the decoded audio signals. Ideally, the decoded signals should be identical to the source signals, with infinite separation among the signals. However, the inherent crosstalk in matrix decoders results in only 3 dB separation between signals associated with adjacent directions. An audio matrix in which the matrix characteristics do not vary is known in the art as a "passive" matrix.

In order to overcome the problem of crosstalk in matrix decoders, it is known in the prior art to adaptively vary the decoding matrix characteristics in order to improve separation among the decoded signals and more closely approximate the source signals. One well known example of such an active matrix decoder is the Dolby Pro Logic decoder, described in U.S. Pat. No. 4,799,260, which patent is incorporated by reference herein in its entirety. The '260 patent cites a number of patents that are prior art to it, many of them describing various other types of adaptive matrix decoders. Other prior art patents include patents by the present inventor, including U.S. Pat. Nos. 5,625,696; 5,644,640; 5,504,819; 5,428,687; and 5,172,415. Each of these patents is also incorporated by reference herein in its entirety.

Although prior art adaptive matrix decoders are intended to reduce crosstalk in the reproduced signals and more closely replicate the source signals, the prior art has done so in ways, many of which being complex and cumbersome, that fail to recognize desirable relationships among intermediate signals in the decoder that may be used to simplify the decoder and to improve the decoder's accuracy.

Accordingly, the present invention is directed to methods and apparatus that recognize and employ heretofore unappreciated relationships among intermediate signals in adaptive matrix decoders. Exploitation of these relationships allows undesired crosstalk components to be cancelled easily, particularly by using automatic self-cancelling arrangements using negative feedback.

SUMMARY OF THE INVENTION

In accordance with a first aspect of the invention, the invention constitutes a method for deriving at least three audio output signals from two input audio signals, in which four audio signals are derived from the two input audio signals by a passive matrix that produces two pairs of audio signals in response to two audio signals: a first pair of derived audio signals representing directions lying on a first axis (such as "left" and "right" signals) and a second pair of derived audio signals representing directions lying on a second axis (such as "center" and "surround" signals), said first and second axes being substantially mutually orthogonal to each other. Each of the pairs of derived audio signals are processed to produce respective first and second pairs (the left/right and center/surround pairs, respectively) of intermediate audio signals such that the magnitudes of the relative amplitudes of the audio signals in each pair of intermediate audio signals are urged toward equality. A first output signal (such as the left output signal $L_{out}$) representing a first direction lying on the axis of the pair of derived audio signals (the left/right pair) from which the first pair (the left/right pair) of intermediate signals are produced, is produced at least by combining, with the same polarity, at least a component of each of the second pair (the center/surround pair) of intermediate audio signals. A second output signal (such as the right output signal $R_{out}$) representing a second direction lying on the axis of the pair of derived audio signals (the left/right pair) from which the first pair (the left/right pair) of intermediate signals are produced, is produced at least by combining, with the opposite polarity, at least a component of each of the second pair (the center/surround pair) of intermediate audio signals. A third output signal (such as the center output signal $C_{out}$ or the surround output signal $S_{out}$) representing a first direction lying on the axis of the pair (the center/surround pair) of derived audio signals from which the second pair (the center/surround pair) of intermediate signals are produced, is produced at least by combining, with the same polarity or the opposite polarity, at least a component of each of the first pair (the left/right pair) of intermediate audio signals. Optionally, a fourth output signal (such as the surround output signal $S_{out}$ if the third output signal is the enter output signal $C_{out}$, or $C_{out}$ if the third output signal is $S_{out}$) representing a second direction lying on the axis of the pair (center/surround) of derived audio signals from which the second pair (center/surround) of intermediate signals are produced, is produced at least by combining, with the opposite polarity, if the third output signal is produced by combining with the same polarity, or by combining with the same polarity, if the third output signal is produced by combining with the opposite polarity, at least a component of each of said first pair (the left/right pair) of intermediate audio signals.

The heretofore unappreciated relationships among the decoded signals is that by urging toward equality the magnitudes of the intermediate audio signals in each pair of intermediate audio signals, undesired crosstalk components in the decoded output signals are substantially suppressed. The principle does not require complete equality in order to achieve substantial crosstalk cancellation. Such processing is readily and preferably implemented by the use of negative feedback arrangements that act to cause automatic cancellation of undesired crosstalk components.

The invention includes embodiments having equivalent topologies. In every embodiment, as described above, intermediate signals are derived from a passive matrix operating on a pair of input signals and those intermediate signals are urged toward equality. In embodiments embodying a first topology, a cancellation component of the intermediate signals are combined with passive matrix signals (from the passive matrix operating on the input signals or otherwise) to produce output signals. In an embodiment employing a second topology, pairs of the intermediate signals are combined to output signals.

Other aspects of the present invention include the derivation of additional control signals for producing additional output signals.

It is a primary object of the invention to achieve a measurably and perceptibly high degree of crosstalk cancellation under a wide variety of input signal conditions, using circuitry with no special requirements for precision, and requiring no unusual complexity in the control path, both of which are found in the prior art.

It is another object of the invention to achieve such high performance with simpler or lower cost circuitry than prior art circuits.

DETAILED DESCRIPTION OF THE PREFERRED EMBODIMENTS

Figure 1:
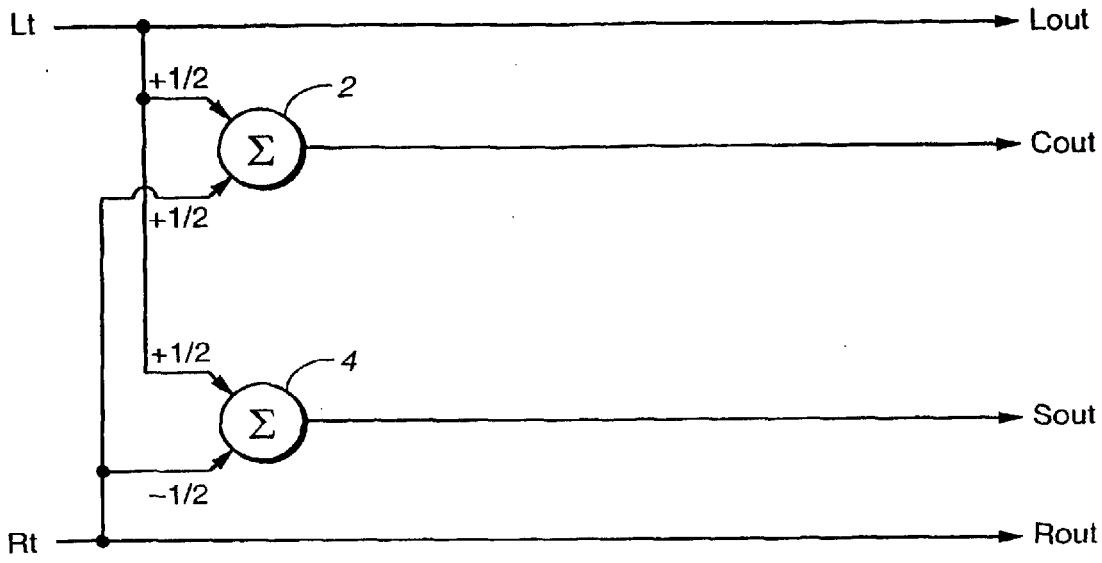
FIG. 1 (PRIOR ART)
FIG. 1 is a functional and schematic diagram of a prior art passive decoding matrix useful in understanding the present invention.

A passive decoding matrix is shown functionally and schematically in FIG. 1. The following equations relate the outputs to the inputs, $L_t$ and $R_t$ ("left total" and "right total"):

$$L_{out}=L_t \quad \text{(Eqn. 1)}$$

$$R_{out}=R_t \quad \text{(Eqn. 2)}$$

$$C_{out}=\tfrac{1}{2}*(L_t+R_t) \quad \text{(Eqn. 3)}$$

$$S_{out}=\tfrac{1}{2}*(L_t-R_t) \quad \text{(Eqn. 4)}$$

(The "*" symbol in these and other equations throughout this document indicates multiplication.)

The center output is the sum of the inputs, and the surround output is the difference between the inputs. Both have, in addition, a scaling; this scaling is arbitrary, and is chosen to be ½ for the purpose of ease in explanation. Other scaling values are possible. The $C_{out}$ output is obtained by applying $L_t$ and $R_t$ with a scale factor of +½ to a linear combiner 2. The $S_{out}$ output is obtained by applying $L_t$ and $R_t$ with scale factors of +½ and −½, respectively, to a linear combiner 4.

The passive matrix of FIG. 1 thus produces two pairs of audio signals; the first pair is $L_{out}$ and $R_{out}$; the second pair is $C_{out}$ and $S_{out}$. In this example, the cardinal directions of the passive matrix are designated "left," "center," "right," and "surround." Adjacent cardinal directions lie on mutually orthogonal axes, such that, for these direction labels, left is adjacent to center and surround; surround is adjacent to left and right, etc. It should be understood that the invention is applicable to any orthogonal 2:4 decoding matrix.

A passive matrix decoder derives n audio signals from m audio signals, where n is greater than m, in accordance with an invariable relationship (for example, in FIG. 1, $C_{out}$ is always $\frac{1}{2}*(R_{out}+L_{out})$) In contrast, an active matrix decoder derives n audio signals in accordance with a variable relationship. One way to configure an active matrix decoder is to combine signal-dependent signal components with the output signals of a passive matrix. For example, as shown functionally and schematically in FIG. 2, four VCAs (voltage-controlled amplifiers) 6, 8, 10 and 12, delivering variably scaled versions of the passive matrix outputs, are summed with the unaltered passive matrix outputs (namely, the two inputs themselves along with the two outputs of combiners 2 and 4) in linear combiners 14, 16, 18, and 20. Because the VCAs have their inputs derived from the left, right, center and surround outputs of the passive matrix, respectively, their gains may be designated $g_l$, $g_r$, $g_c$, and $g_s$, (all positive). The VCA output signals constitute cancellation signals and are combined with passively derived outputs having crosstalk from the directions from which the cancellation signals are derived in order to enhance the matrix decoder's directional performance by suppressing crosstalk.

Figure 2:
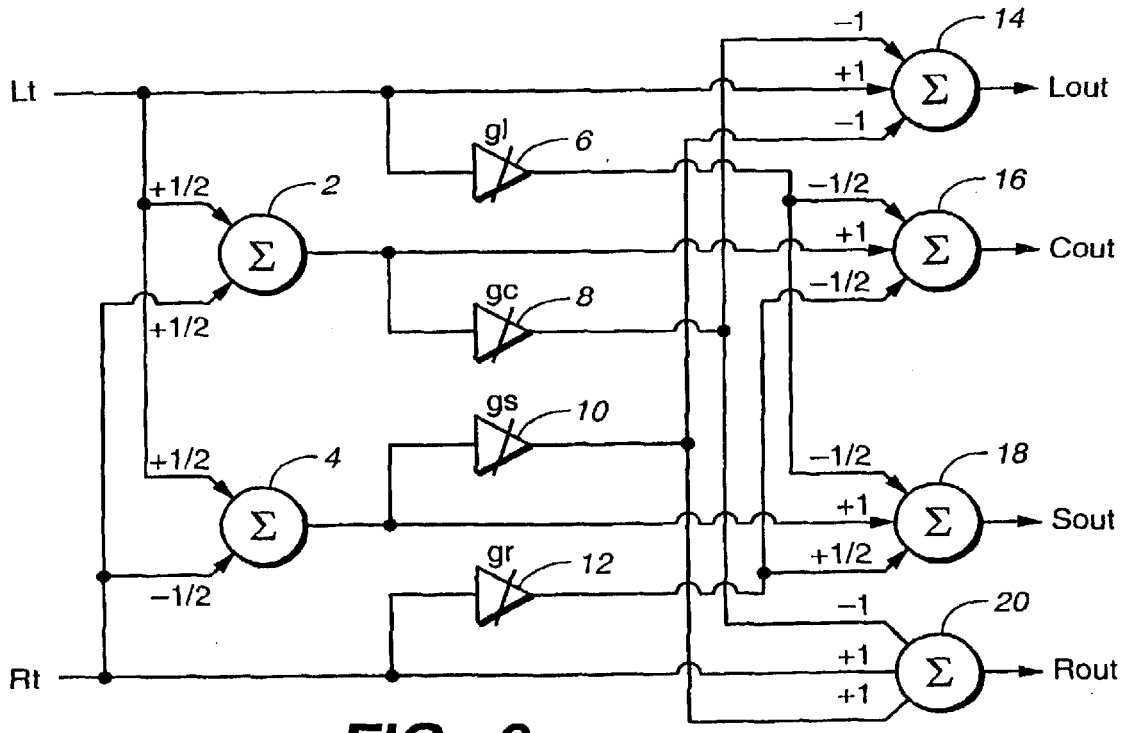
FIG. 2 (PRIOR ART)
FIG. 2 is a functional and schematic diagram of a prior art active matrix decoder useful in understanding the present invention in which variably scaled versions of a passive matrix' outputs are summed with the unaltered passive matrix' outputs in linear combiners.

Note that, in the arrangement of FIG. 2, the paths of the passive matrix are still present. Each output is the combination of the respective passive matrix output plus the output of two VCAS. The VCA outputs are selected and scaled to provide the desired crosstalk cancellation for the respective passive matrix output, taking into consideration that crosstalk components occur in outputs representing adjacent cardinal directions. For example, a center signal has crosstalk in the passively decoded left and right signals and a surround signal has crosstalk in the passively decoded left and right signals. Accordingly, the left signal output should be combined with cancellation signal components derived from the passively decoded center and surround signals, and similarly for the other four outputs. The manner in which the signals are scaled, polarized, and combined in FIG. 2 provides the desired crosstalk suppression. By varying the respective VCA gain in the range of zero to one (for the scaling example of FIG. 2), undesired crosstalk components in the passively decoded outputs may be suppressed.

The arrangement of FIG. 2 has the following equations:

$$L_{out}=L_t-g_c*\tfrac{1}{2}*(L_t+R_t)-g_s*\tfrac{1}{2}*(L_t-R_t) \quad \text{(Eqn. 5)}$$

$$R_{out}=R_t-g_c*\tfrac{1}{2}*(L_t+R_t)+g_s*\tfrac{1}{2}*(L_t-R_t) \quad \text{(Eqn. 6)}$$

$$C_{out}=\tfrac{1}{2}*(L_t+R_t)-g_l*\tfrac{1}{2}*L_t-g_r*\tfrac{1}{2}*R_t \quad \text{(Eqn. 7)}$$

$$S_{out}\tfrac{1}{2}*(L_t-R_t)-g_l*\tfrac{1}{2}*L_t+g_r*\tfrac{1}{2}*R_t \quad \text{(Eqn. 8)}$$

If all the VCAs had gains of zero, the arrangement would be the same as the passive matrix. For any equal values of all VCA gains, the arrangement of FIG. 2 is the same as the passive matrix apart from a constant scaling. For example, if all VCAs had gains of 0.1:

$$L_{out}=L_t-0.05*(L_t+R_t)-0.05*(L_t-R_t)=0.9*L_t$$

$$R_{out}=R_t-0.05*(L_t+R_t)+0.05(L_t-R_t)=0.9*R_t$$

$$C_{out}\tfrac{1}{2}*(L_t+R_t)-0.05*L_t-0.05*R_t=0.9*\tfrac{1}{2}*(L_t+R_t)$$

$$S_{out}=\tfrac{1}{2}*(L_t-R_t)-0.05*L_t+0.05*R_t=0.9*\tfrac{1}{2}*(L_t-R_t)$$

The result is the passive matrix scaled by a factor 0.9. Thus, it will be apparent that the precise value of the quiescent VCA gain, described below, is not critical.

Consider an example. For the cardinal directions (left, right, center and surround) only, the respective inputs are $L_t$ only, $R_t$ only, $L_t=R_t$ (the same polarity), and $L_t=-R_t$ (opposite polarity), and the corresponding desired outputs are $L_{out}$ only, $R_{out}$ only, $C_{out}$ only and $S_{out}$ only. In each case, ideally, one output only should deliver one signal, and the remaining ones should deliver nothing.

By inspection, it is apparent that if the VCAs can be controlled so that the one corresponding to the desired cardinal direction has a gain of 1 and the remaining ones are much less than 1, then at all outputs except the desired one, the VCA signals will cancel the unwanted outputs. As explained above, in the FIG. 2 configuration, the VCA outputs act to cancel crosstalk components in the adjacent cardinal directions (into which the passive matrix has crosstalk).

Thus, for example, if both inputs are fed with equal in-phase signals, so $R_t=L_t=$(say) 1, and if as a result $g_c=1$ and $g_l$, $g_r$, and $g_s$, are all zero or near zero, one gets:

$$L_{out}=1-1*\tfrac{1}{2}*(1+1)-0*\tfrac{1}{2}*(1-1)=0$$

$$R_{out}=1-1*\tfrac{1}{2}*(1+1)+0*\tfrac{1}{2}*(1-1)=0$$

$$C_{out}=\tfrac{1}{2}*(1+1)-0*\tfrac{1}{2}*1-0*\tfrac{1}{2}*1=1$$

$$S_{out}=\tfrac{1}{2}*(1-1)-0*\tfrac{1}{2}*1+0*\tfrac{1}{2}*1=0$$

The only output is from the desired $C_{out}$. A similar calculation will show that the same applies to the case of a signal only from one of the other three cardinal directions.

Equations 5, 6, 7 and 8 can be written equivalently as follows:

$$L_{out}=\tfrac{1}{2}*(L_t+R_t)*(1-g_c)+\tfrac{1}{2}*(L_t-R_t)*(1-g_s) \quad \text{(Eqn. 9)}$$

$$C_{out}=\tfrac{1}{2}*L_t*(1-g_l)+\tfrac{1}{2}*R_t*(1-g_r) \quad \text{(Eqn. 10)}$$

$$R_{out}=\tfrac{1}{2}*(L_t+R_t)*(1-g_c)-\tfrac{1}{2}*(L_t-R_t)*(1-g_s) \quad \text{(Eqn. 11)}$$

$$S_{out}=\tfrac{1}{2}*L_t*(1-g_l)-\tfrac{1}{2}*R_t*(1-g_r) \quad \text{(Eqn. 12)}$$

In this arrangement, each output is the combination of two signals. $L_{out}$ and $R_{out}$ both involve the sum and difference of the input signals and the gains of the sum and difference VCAs (the VCAs whose inputs are derived from the center and surround directions, the pair of directions orthogonal to the left and right directions). $C_{out}$ and $S_{out}$ both involve the actual input signals and the gains of the left and right VCAs (the VCAs whose respective inputs are derived from the left and right directions, the pair of directions orthogonal to the center and surround directions).

Consider a non-cardinal direction, where $R_t$ is fed with the same signal as $L_t$ with the same polarity but attenuated. This condition represents a signal placed somewhere between the left and center cardinal directions, and should therefore deliver outputs from $L_{out}$ and $C_{out}$, with little or nothing from $R_{out}$ and $S_{out}$.

For $R_{out}$ and $S_{out}$, this zero output can be achieved if the two terms are equal in magnitude but opposite in polarity.

For $R_{out}$, the relationship for this cancellation is $$\text{magnitude of } [\tfrac{1}{2}*(L_t+R_t)*(\mathbf{1}-g_c)]= \quad \text{(Eqn. 13)}$$
$$\text{magnitude of } [\tfrac{1}{2}*(L_t-R_t)*(\mathbf{1}-g_s)]$$

For $S_{out}$, the corresponding relationship is $$\text{magnitude of } [\tfrac{1}{2}*L_t*(\mathbf{1}-g_l)]= \quad \text{(Eqn. 14)}$$
$$\text{magnitude of } [\tfrac{1}{2}*R_t*(\mathbf{1}-g_r)]$$

A consideration of a signal panned (or, simply, positioned) between any two adjacent cardinal directions will reveal the same two relationships. In other words, when the input signals represent a sound panned between any two adjacent outputs, these magnitude relationships will ensure that the sound emerges from the outputs corresponding to those two adjacent cardinal directions and that the other two outputs deliver nothing. In order substantially to achieve that result, the magnitudes of the two terms in each of the equations 9–12 should be urged toward equality. This may be achieved by seeking to keep equal the relative magnitudes of two pairs of signals within the active matrix:

$$\text{magnitude of } [(L_t+R_t)*(1-g_c)] = \text{magnitude of } [(L_t-R_t)*(1-g_s)], \quad \text{(Eqn. 15)}$$

and $$\text{magnitude of } [L_t*(1-g_l)] = \text{magnitude of } [R_t*(1-g_r)]. \quad \text{(Eqn. 16)}$$

The desired relationships, shown in Equations 15 and 16 are the same as those of Equations 13 and 14 but with the scaling omitted. The polarity with which the signals are combined and their scaling may be taken care of when the respective outputs are obtained as with the combiners 14, 16, 18 and 20 of FIG. 2.

The invention is based on the discovery of these heretofore unappreciated equal amplitude magnitude relationships, and, preferably, as described below; the use of self-acting feedback control to maintain these relationships.

From the discussion above concerning cancellation of undesired crosstalk signal components and from the requirements for the cardinal directions, it can be deduced that for the scaling used in this explanation, the maximum gain for a VCA should be unity. Under quiescent, undefined, or "unsteered" conditions, the VCAs should adopt a small gain, providing effectively the passive matrix. When the gain of one VCA of a pair needs to rise from its quiescent value towards unity, the other of the pair may remain at the quiescent gain or may move in the opposite direction. One convenient and practical relationship is to keep the product of the gains of the pair constant. Using analog VCAs, whose gain in dB is a linear function of their control voltage, this happens automatically if a control voltage is applied equally (but with effective opposite polarity) to the two of a pair. Another alternative is to keep the sum of the gains of the pair constant. Of course, the invention may be implemented digitally or in software rather than by using analog components.

Thus, for example, if the quiescent gain is 1/a, a practical relationship between the two gains of the pairs might be their product such that $$g_l*g_r=1/a^2, \text{ and}$$

$$g_c*g_s=1/a^2.$$

A typical value for "a" might lie in the range 10 to 20.

Figure 3:
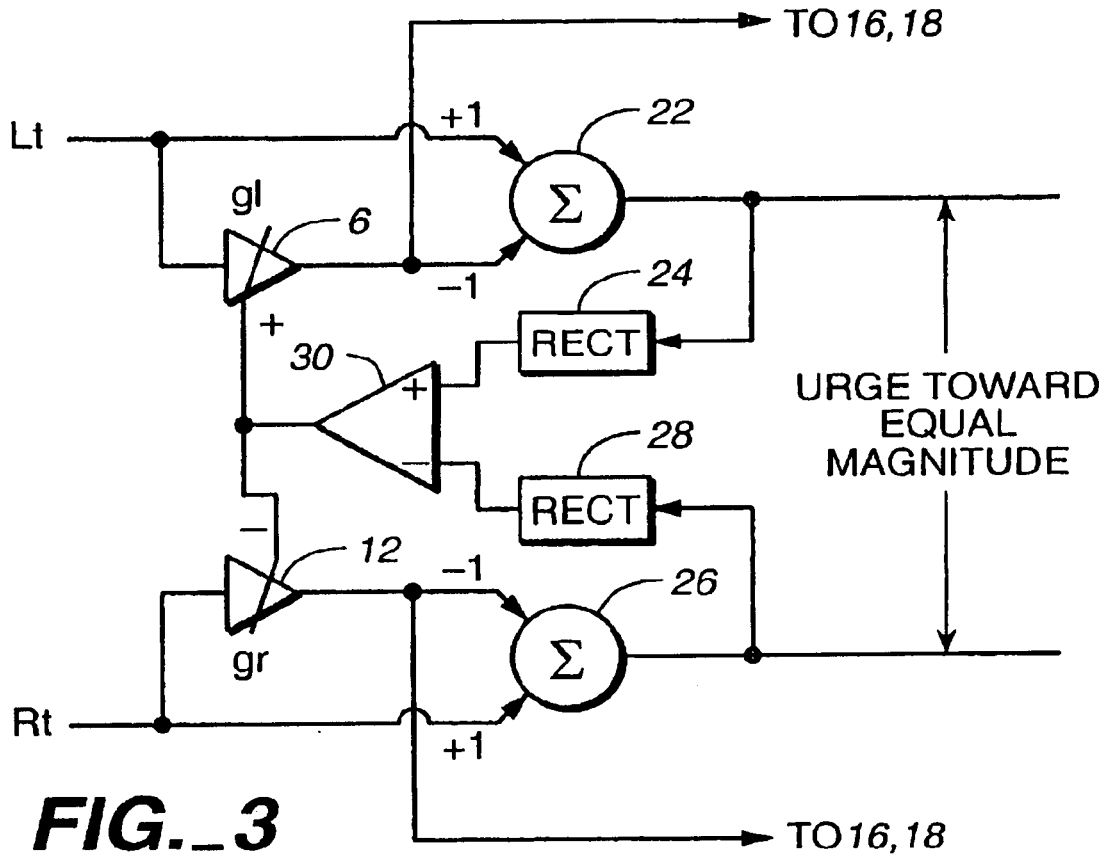
FIG. 3 is a functional and schematic diagram of a feedback-derived control system according to the present invention for the left and right VCAs and the sum and difference VCAs of FIG. 2 and for VCAs in other embodiments of the present invention.

FIG. 3 shows, functionally and schematically, a feedback-derived control system for the left and right VCAs (6 and 12, respectively) of FIG. 2. It receives the $L_t$ and $R_t$ input signals, processes them to derive intermediate $L_t*(1-g_l)$ and $R_t*(1-g_r)$ signals, compares the magnitude of the intermediate signals, and generates an error signal in response to any difference in magnitude, the error signal causing the VCAs to reduce the difference in magnitude. One way to achieve such a result is to rectify the intermediate signals to derive their magnitudes and apply the two magnitude signals to a comparator whose output controls the gains of the VCAs with such a polarity that, for example, an increase in the $L_t$ signal increases $g_l$ and decreases $g_r$. Circuit values (or their equivalents in digital or software implementations) are chosen so that when the comparator output is zero, the quiescent amplifier gain is less than unity (e.g., 1/a).

In the analog domain, a practical way to implement the comparison function is to convert the two magnitudes to the logarithm domain so that the comparator subtracts them rather than determining their ratio. Many analog VCAs have gains proportional to an exponent of the control signal, so that they inherently and conveniently take the antilog of the control outputs of logarithmically-based comparator. In contrast, however, if implemented digitally, it may be more convenient to divide the two magnitudes and use the results as direct multipliers or divisors for the VCA functions.

More specifically, as shown in FIG. 3, the $L_t$ input is applied to the "left" VCA 6 and to one input of a linear combiner 22 where it is applied with a scaling of +1. The left VCA 6 output is applied to the combiner 22 with a scaling of −1 (thus forming a subtractor) and the output of combiner 22 is applied to a full-wave rectifier 24. The $R_t$ input is applied to the right VCA 12 and to one input of a linear combiner 26 where it is applied with a scaling of +1. The right VCA 12 output is applied to the combiner 26 with a scaling of −1 (thus forming a subtractor) and the output of combiner 26 is applied to a full-wave rectifier 28. The rectifier 24 and 28 outputs are applied, respectively, to non-inverting and inverting inputs of an operational amplifier 30, operating as a differential amplifier. The amplifier 30 output provides a control signal in the nature of an error signal that is applied without inversion to the gain controlling input of VCA 6 and with polarity inversion to the gain controlling input of VCA 12. The error signal indicates that the two signals, whose magnitudes are to be equalized, differ in magnitude. This error signal is used to "steer" the VCAs in the correct direction to reduce the difference in magnitude of the intermediate signals. The outputs to the combiners 16 and 18 are taken from the VCA 6 and VCA 12 outputs. Thus, only a component of each intermediate signal is applied to the output combiners, namely, $-L_tg_r$ and $-R_tg_l$.

For steady-state signal conditions, the difference in magnitude may be reduced to a negligible amount by providing enough loop gain. However, it is not necessary to reduce the differences in magnitude to zero or a negligible amount in order to achieve substantial crosstalk cancellation. For example, a loop gain sufficient to reduce the dB difference by a factor of 10 results, theoretically, in worst-case crosstalk better than 30 dB down. For dynamic conditions, time constants in the feedback control arrangement should be chosen to urge the magnitudes toward equality in a way that is essentially inaudible at least for most signal conditions. Details of the choice of time constants in the various configurations described are beyond the scope of the invention.

Preferably, circuit parameters are chosen to provide about 20 dB of negative feedback and so that the VCA gains cannot rise above unity. The VCA gains may vary from some small value (for example, $1/a_2$, much less than unity) up to, but not exceeding, unity for the scaling examples described herein in connection with the arrangements of FIGS. 2, 4 and 5. Due to the negative feedback, the arrangement of FIG. 3 will act to hold the signals entering the rectifiers approximately equal.

Since the exact gains are not critical when they are small, any other relationship that forces the gain of one of the pair to a small value whenever the other rises towards unity will cause similar acceptable results.

The feedback-derived control system for the center and surround VCAs (8 and 10, respectively) of FIG. 2 is substantially identical to the arrangement of FIG. 3, as described, but receiving not $L_t$ and $R_t$ but their sum and difference and applying its outputs from VCA 6 and VCA 12 (constituting a component of the respective intermediate signal) to combiners 14 and 20.

Thus, a high degree of crosstalk cancellation may be achieved under a wide variety of input signal conditions using circuitry with no special requirements for precision while employing a simple control path that is integrated into the signal path. The feedback-derived control system operates to process pairs of audio signals from the passive matrix such that the magnitudes of the relative amplitudes of the intermediate audio signals in each pair of intermediate audio signals are urged toward equality.

The feedback-derived control system shown in FIG. 3 controls the gains of the two VCAs 6 and 12 inversely to urge the inputs to the rectifiers 24 and 28 towards equality. The degree to which these two terms are urged towards equality depends on the characteristics of the rectifiers, the comparator 30 following them and of the gain/control relationships of the VCAs. The greater the loop-gain, the closer the equality, but an urging towards equality will occur irrespective of the characteristics of these elements (provided of course the polarities of the signals are such as to reduce the level differences). In practice the comparator may not have infinite gain but may be realized as a subtractor with finite gain.

If the rectifiers are linear, that is, if their outputs are directly proportional to the input magnitudes, the comparator or subtractor output is a function of the signal voltage or current difference. If instead the rectifiers respond to the logarithm of their input magnitudes, that is to the level expressed in dB, a subtraction performed at the comparator input is equivalent to taking the ratio of the input levels. This is beneficial in that the result is then independent of the absolute signal level but depends only on the difference in signal expressed in dB. Considering the source signal levels expressed in dB to reflect more nearly human perception, this means that other things being equal the loop-gain is independent of loudness, and hence that the degree of urging towards equality is also independent of absolute loudness. At some very low level, of course, the logarithmic rectifiers will cease to operate accurately, and therefore there will be an input threshold below which the urging towards equality will cease. However, the result is that control can be maintained over a 70 or more dB range without the need for extraordinarily high loop-gains for high input signal levels, with resultant potential problems with stability of the loop.

Similarly, the VCAs 6 and 12 may have gains that are directly or inversely proportional to their control voltages (that is, multipliers or dividers). This would have the effect that when the gains were small, small absolute changes in control voltage would cause large changes in gain expressed in dB. For example, consider a VCA with a maximum gain of unity, as required in this feedback-derived control system configuration, and a control voltage $V_c$ that varies from say 0 to 10 volts, so that the gain can be expressed as $A=0.1*V_c$. When $V_c$ is near its maximum, a 100 mV (millivolt) change from say 9900 to 10000 mV delivers a gain change of 20*log(10000/9900) or about 0.09 dB. When $V_c$ is much smaller, a 100 mV change from say 100 to 200 mV delivers a gain change of 20*log(200/100) or 6 dB. As a result, the effective loop-gain, and, hence, rate of response, would vary hugely depending whether the control signal was large or small. Again, there can be problems with the stability of the loop.

This problem can be eliminated by employing VCAs whose gain in dB is proportional to the control voltage, or expressed differently, whose voltage or current gain is dependent upon the exponent or antilog of the control voltage. A small change in control voltage such as 100 mV will then give the same dB change in gain wherever the control voltage is within its range. Such devices are readily available as analog ICs, and the characteristic, or an approximation to it, is easily achieved in digital implementations.

The preferred embodiment therefore employs logarithmic rectifiers and exponentially controlled variable gain amplification, delivering more nearly uniform urging towards equality (considered in dB) over a wide range of input levels and of ratios of the two input signals.

Since in human hearing the perception of direction is not constant with frequency, it is desirable to apply some frequency weighting to the signals entering the rectifiers, so as to emphasize those frequencies that contribute most to the human sense of direction and to deemphasize those that might lead to inappropriate steering. Hence, in practical embodiments, the rectifiers 24 and 28 in FIG. 3 are preceded by filters derived empirically, providing a response that attenuates low frequencies and very high frequencies and provides a gently rising response over the middle of the audible range. Note that these filters do not alter the frequency response of the output signals, they merely alter the control signals and VCA gains in the feedback-derived control systems.

Figure 4:
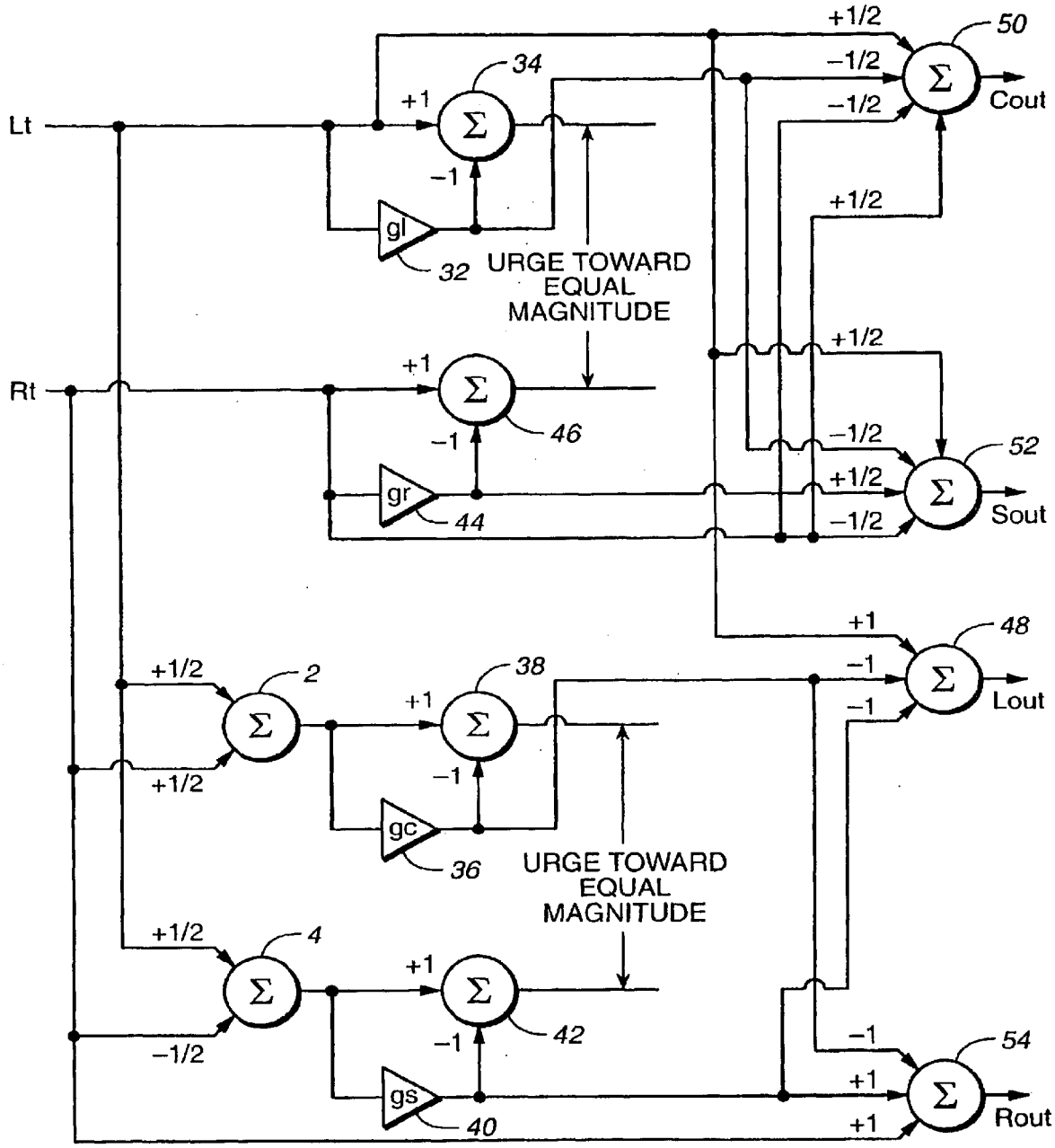
FIG. 4 is a functional and schematic diagram showing an arrangement according to the present invention equivalent to the combination of FIGS. 2 and 3 in which the output combiners generate the passive matrix output signal components in response to the $L_t$ and $R_t$ input signals instead of receiving them from the passive matrix from which the cancellation components are derived.

An arrangement equivalent to the combination of FIGS. 2 and 3 is shown functionally and schematically in FIG. 4. It differs from the combination of FIGS. 2 and 3 in that the output combiners generate passive matrix output signal components in response to the $L_t$ and $R_t$ input signals instead of receiving them from the passive matrix from which the cancellation components are derived. The arrangement provides the same results as does the combination of FIGS. 2 and 3 provided that the summing coefficients are essentially the same in the passive matrices. FIG. 4 incorporates the feedback arrangements described in connection with FIG. 3.

More specifically, in FIG. 4, the $L_t$ and $R_t$ inputs are applied first to a passive matrix that includes combiners 2 and 4 as in the FIG. 1 passive matrix configuration. The $L_t$ input, which is also the passive matrix "left" output, is applied to the "left" VCA 32 and to one input of a linear combiner 34 with a scaling of +1. The left VCA 32 output is applied to a combiner 34 with a scaling of −1 (thus forming a subtractor). The $R_t$ input, which is also the passive matrix "right" output, is applied to the "right" VCA 44 and to one input of a linear combiner 46 with a scaling of +1. The right VCA 44 output is applied to the combiner 46 with a scaling of −1 (thus forming a subtractor): The outputs of combiners 34 and 46 are the signals $L_t*(1-g_l)$ and $R_t*(1-g_r)$, respectively, and it is desired to keep the magnitude of those signals equal or to urge them toward equality. To achieve that result, those signals preferably are applied to a feedback circuit such as shown in FIG. 3 and described in connection therewith. The feedback circuit then controls the gain of VCAs 32 and 44.

In addition, still referring to FIG. 4, the "center" output of the passive matrix from combiner 2 is applied to the "center" VCA 36 and to one input of a linear combiner 38 with a scaling of +1. The center VCA 36 output is applied to the combiner 38 with a scaling of −1 (thus forming a subtractor). The "surround" output of the passive matrix from combiner 4 is applied to the "surround" VCA 40 and to one input of a linear combiner 42 with a scaling of +1. The surround VCA 40 output is applied to the combiner 42 with a scaling of −1 (thus forming a subtractor). The outputs of combiners 38 and 42 are the signals $\frac{1}{2}*(L_t+R_t)*(1-g_c)$ and $\frac{1}{2}*(L_t-R_t)*(1-g_s)$, respectively, and it is desired to keep the magnitude of those signals equal or to urge them toward equality. To achieve that result, those signals preferably are applied to a feedback circuit such as shown in FIG. 3 and described in connection therewith. The feedback circuit then controls the gain of VCAs 38 and 42.

The output signals $L_{out}$, $C_{out}$, $S_{out}$, and $R_{out}$ are produced by combiners 48, 50, 52 and 54. Each combiner receives the output of two VCAs (the VCA outputs constituting a component of the intermediate signals whose magnitudes are sought to be kept equal) to provide cancellation signal components and either or both input signals so as to provide passive matrix signal components. More specifically, the input signal $L_t$ is applied with a scaling of +1 to the $L_{out}$ combiner 48, with a scaling of +½ to the $C_{out}$ combiner 50, and with a scaling of +½ to the $S_{out}$ combiner 52. The input signal $R_t$ is applied with a scaling of +1 to the $R_{out}$ combiner 54, with a scaling of +½ to $C_{out}$ combiner 50, and with a scaling of −½ to $S_{out}$ combiner 52. The left VCA 32 output is applied with a scaling of −½ to $C_{out}$ combiner 50 and also with a scaling of −½ to $S_{out}$ combiner 52. The right VCA 44 output is applied with a scaling of −½ to $C_{out}$ combiner 50 and with a scaling of +½ to $S_{out}$ combiner 52. The center VCA 36 output is applied with a scaling of −1 to $L_{out}$ combiner 48 and with a scaling of −1 to $R_{out}$ combiner 54. The surround VCA 40 output is applied with a scaling of −1 to $L_{out}$ VCA 48 and with a scaling of +1 to $R_{out}$ VCA 54.

It will be noted that in various ones of the figures, for example in FIGS. 2 and 4, it may initially appear that cancellation signals do not oppose the passive matrix signals (for example, some of the cancellation signals are applied to combiners with the same polarity as the passive matrix signal is applied). However, in operation, when a cancellation signal becomes significant it will have a polarity that does oppose the passive matrix signal.

Figure 5:
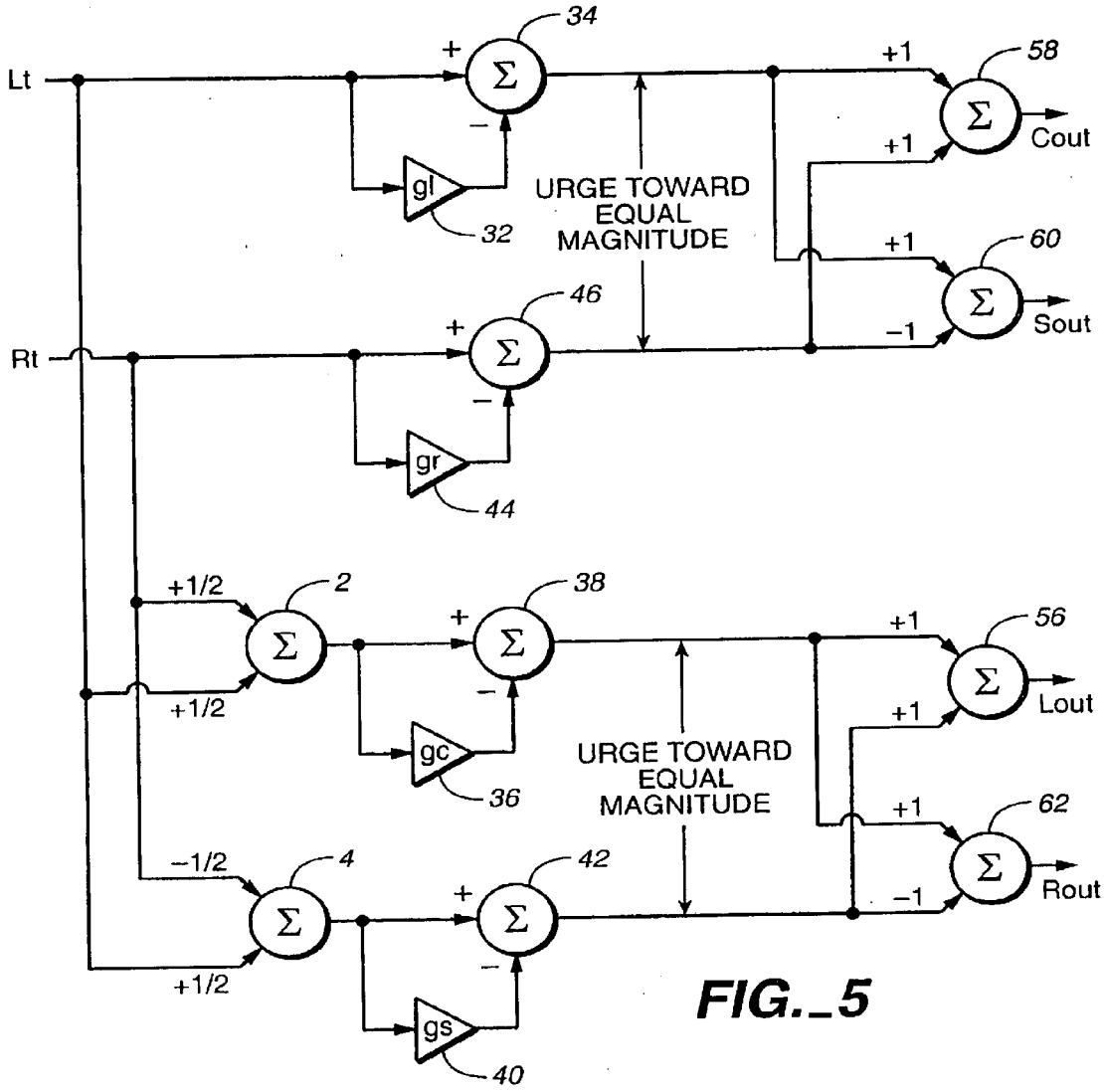
FIG. 5 is a functional and schematic diagram according to the present invention showing an arrangement equivalent to the combination of FIGS. 2 and 3 and FIG. 4. In the FIG. 5 configuration, the signals that are to be maintained equal are the signals applied to the output deriving combiners and to the feedback circuits for control of the VCAs; the outputs of the feedback circuits include the passive matrix components.

Another arrangement equivalent to the combination of FIGS. 2 and 3 and to FIG. 4 is shown functionally and schematically in FIG. 5. In the FIG. 5 configuration, the signals that are to be maintained equal are the signals applied to the output deriving combiners and to the feedback circuits for control of the VCAs. These signals include passive matrix output signal components. In contrast, in the arrangement of FIG. 4 the signals applied to the output combiners from the feedback circuits are the VCA output signals and exclude the passive matrix components. Thus, in FIG. 4 (and in the combination of FIGS. 2 and 3), passive matrix components must be explicitly combined with the outputs of the feedback circuits, whereas in FIG. 5 the outputs of the feedback circuits include the passive matrix components and are sufficient in themselves. It will also be noted that in the FIG. 5 arrangement the intermediate signal outputs rather than the VCA outputs (each of which constitutes only a component of the intermediate signal) are applied to the output combiners. Nevertheless, the FIG. 4 and FIG. 5 (along with the combination of FIGS. 2 and 3) configurations are equivalent, and, if the summing coefficients are accurate, the outputs from FIG. 5 are the same as those from FIG. 4 (and the combination of FIGS. 2 and 3).

In FIG. 5, the four intermediate signals, $[\frac{1}{2}*(L_t+R_t)*(1-g_c)]$, $[\frac{1}{2}*(L_t-R_t)*(1-g_s)]$, $[\frac{1}{2}*L_t*(1-g_l)]$, and $[\frac{1}{2}*R_t*(1-g_r)]$, in the equations 9, 10, 11 and 12 are obtained by processing the passive matrix outputs and are then added or subtracted to derive the desired outputs. The signals also are fed to the rectifiers and comparators of two feedback circuits, as described above in connection with FIG. 3, the feedback circuits desirably acting to hold the magnitudes of the pairs of signals equal. The feedback circuits of FIG. 3, as applied to the FIG. 5 configuration, have their outputs to the output combiners taken from the outputs of the combiners 22 and 26 rather than from the VCAs 6 and 12.

Still referring to FIG. 5, the connections among combiners 2 and 4, VCAs 32, 36, 40, and 44, and combiners 34, 38, 42 and 46 are the same as in the arrangement of FIG. 4. Also, in both the FIG. 4 and FIG. 5 arrangements, the outputs of the combiners 34, 38, 42 and 46 preferably are applied to two feedback control circuits (the outputs of combiners 34 and 46 to a first such circuit in order to generate control signals for VCAs 32 and 44 and the outputs of combiners 38 and 42 to a second such circuit in order to generate control signals for VCAs 36 and 40). In FIG. 5 the output of combiner 34, the $L_t*(1-g_l)$ signal, is applied with a scaling of +1 to the $C_{out}$ combiner 58 and with a scaling of +1 to the $S_{out}$ combiner 60. The output of combiner 46, the $R_t*(1-g_r)$ signal is applied with a scaling of +1 to the $C_{out}$ combiner 58 and with a scaling of −1 to the $S_{out}$ combiner 60. The output of combiner 38, the $\frac{1}{2}*(L_t+R_t)*(1-g_c)$ signal, is applied to the $L_{out}$ combiner 56 with a scaling of +1 and to the $R_{out}$ combiner 62 with a scaling of +1. The output of the combiner 42, the $\frac{1}{2}*(L_t-R_t)*(1-g_s)$ signal, is applied to the $L_{out}$ combiner 56 with a +1 scaling and to the $R_{out}$ combiner 62 with a −1 scaling.

Unlike prior art adaptive matrix decoders, whose control signals are generated from the inputs, the invention preferably employs a closed-loop control in which the magnitudes of the signals providing the outputs are measured and fed back to provide the adaptation. In particular, unlike prior art open-loop systems, the desired cancellation of unwanted signals for non-cardinal directions does not depend on an accurate matching of characteristics of the signal and control paths, and the closed-loop configurations greatly reduce the need for precision in the circuitry.

Ideally, aside from practical circuit shortcomings, "keep magnitudes equal" configurations of the invention are "perfect" in the sense that any source fed into the $L_t$ and $R_t$ inputs with known relative amplitudes and polarity will yield signals from the desired outputs and negligible signals from the others. "Known relative amplitudes and polarity" means that the $L_t$ and $R_t$ inputs represent either a cardinal direction or a position between adjacent cardinal directions.

Considering the equations 9, 10, 11 and 12 again, it will be seen that the overall gain of each variable gain circuit incorporating a VCA is a subtractive arrangement in the form 1-g). Each VCA gain can vary from a small value up to but not exceeding unity. Correspondingly, the variable-gain-circuit gain (1-g) can vary from very nearly unity down to zero. Thus, FIG. 5 can be redrawn as FIG. 6, where every VCA and associated subtractor has been replaced by a VCA alone, whose gain varies in the opposite direction to that of the VCAs in FIG. 5. Thus every variable-gain-circuit gain 1-g) (implemented, for example by a VCA having a gain "g" whose output is subtracted from a passive matrix output as in FIGS. 2/3, 4 and 5) is replaced by a corresponding variable-gain-circuit gain "h" (implemented, for example by a stand-alone VCA having a gain "h" acting on a passive matrix output). If the characteristics of gain "1-g)" is the same as gain "h" and if the feedback circuits act to maintain equality between the magnitude of the requisite pairs of signals, the FIG. 6 configuration is equivalent to the FIG. 5 configuration and will deliver the same outputs. Indeed, all of the disclosed configurations, the configurations of FIGS. 2/3, 4, 5, and 6, are equivalent to each other.

Figure 6:
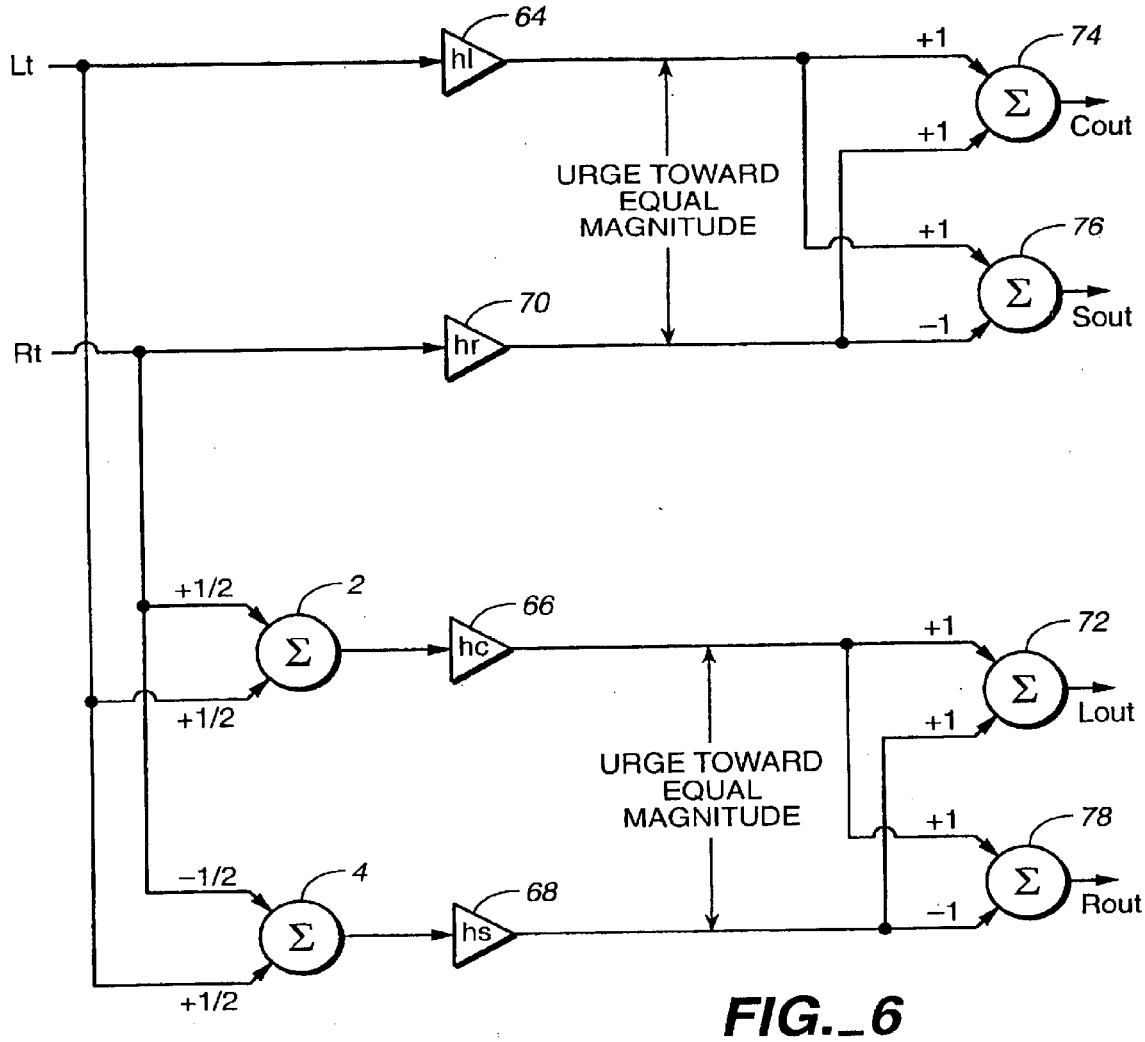
FIG. 6 is a functional and schematic diagram according to the present invention-showing an arrangement equivalent to the arrangements of the combination of FIGS. 2 and 3 FIG. 4 and FIG. 5, in which the variable-gain-circuit gain (1-g) provided by a VCA and subtractor is replaced by a VCA whose gain varies in the opposite direction of the VCAs in the VCA and subtractor configurations. In this embodiment, the passive matrix components are implicit. In the other embodiments, the passive matrix components are explicit.

Although the FIG. 6 configuration is equivalent and functions exactly the same as all the prior configurations, note that the passive matrix does not appear explicitly but is implicit. In the quiescent or unsteered condition of the prior configurations, the VCA gains g fall to small values. In the FIG. 6 configuration, the corresponding unsteered condition occurs when all the VCA gains h rise to their maximum, unity or close to it.

Referring to FIG. 6 more specifically, the "left" output of the passive matrix, which is also the same as the input signal $L_t$, is applied to a "left" VCA 64 having a gain $h_l$ to produce the intermediate signal $L_t*h_l$. The "right" output of the passive matrix, which is also the same as the input signal $R_t$, is applied to a "right" VCA 70 having a gain $h_r$ to produce the intermediate signal $R_t*h_r$. The "center" output of the passive matrix from combiner 2 is applied to a "center" VCA 66 having a gain $h_c$ to produce an intermediate signal $\frac{1}{2}*(L_t+R_t)*h_c$. The "surround" output of the passive matrix from combiner 4 is applied to a "surround" VCA 68 having a gain $h_s$ to produce an intermediate signal $\frac{1}{2}*(L_t-R_t)*h_s$. As explained above, the VCA gains h operate inversely to the VCA gains g, so that the h gain characteristics are the same as the 1-g) gain characteristics.

Generation of Control Voltages

An analysis of the control signals developed in connection with the embodiments described thus far is useful in better understanding the present invention and in explaining how the teachings of the present invention may be applied to deriving five or more audio signal streams, each associated with a direction, from a pair of audio input signal streams.

In the following analysis, the results will be illustrated by considering an audio source that is panned clockwise around the listener in a circle, starting at the rear and going via the left, center front, right and back to the rear. The variable $\alpha$ is a measure of the angle (in degrees) of the image with respect to a listener, 0 degrees being at the rear and 180 degrees at the center front. The input magnitudes $L_t$ and $R_t$ are related to $\alpha$ by the following expressions:

$$Lt = \cos\left[\pi \cdot \frac{(\alpha - 90)}{360}\right] \quad \text{(Eqn. 17A)}$$

$$Rt = \sin\left[\pi \cdot \frac{(\alpha - 90)}{360}\right] \quad \text{(Eqn. 17B)}$$

There is a one-to-one mapping between the parameter a and the ratio of the magnitudes and the polarities of the input signals; use of a leads to more convenient analysis. When $\alpha$ is 90 degrees, $L_t$ is finite and $R_t$ is zero, i.e., left only. When $\alpha$ is 180 degrees, $L_t$ and $R_t$ are equal with the same polarity (center front). When $\alpha$ is 0, $L_t$ and $R_t$ are equal but with opposite polarities (center rear). As is explained further below, particular values of interest occur when $L_t$ and $R_t$ differ by 5 dB and have opposite polarity; this yields $\alpha$ values of 31 degrees either side of zero. In practice, the left and right front loudspeakers are generally placed further forward than +/−90 degrees relative to the center (for example, +/−to, 45 degrees), so $\alpha$ does not actually represent the angle with respect to the listener but is an arbitrary parameter to illustrate panning. The figures to be described are arranged so that the middle of the horizontal axis ($\alpha$=180 degrees) represents center front and the left and right extremes ($\alpha$=0 and 360) represent the rear.

As discussed above in connection with the description of FIG. 3, a convenient and practical relationship between the gains of a pair of VCAs in a feedback-derived control system holds their product constant. With exponentially controlled VCAs fed so that as the gain of one rises the gain of the other falls, this happens automatically when the same control signal feeds both of the pair, as in the embodiment of FIG. 3.

Denoting the input signals by $L_t$ and $R_t$, setting the product of the VCA gains $g_l$ and $g_r$ equal to $1/a^2$, and assuming sufficiently great loop-gain that the resultant urging towards equality is complete, the feedback-derived control system of FIG. 3 adjusts the VCA gains so that the following equation is satisfied:

$$|Lt|\cdot(1-gl)=|Rt|\cdot(1-gr) \quad \text{(Eqn. 18)}$$

In addition, $$gl \cdot gr = \frac{1}{a^2} \quad \text{(Eqn. 19)}$$

Clearly, in the first of these equations, the absolute magnitudes of $L_t$ and $R_t$ are irrelevant. The result depends only on their ratio $L_t/R_t$; call this X. Substituting $g_r$ from the second equation into the first, one obtains a quadratic equation in $g_l$ that has the solution (the other root of the quadratic does not represent a real system):

$$gl = \frac{1}{2} \cdot \frac{\left[X \cdot a^2 - a^2 + \sqrt{a^2 \cdot (X^2 \cdot a^2 - 2 \cdot X \cdot a^2 + a^2 + 4 \cdot X)}\right]}{X \cdot a^2} \quad \text{(Eqn. 20)}$$

Figure 7:
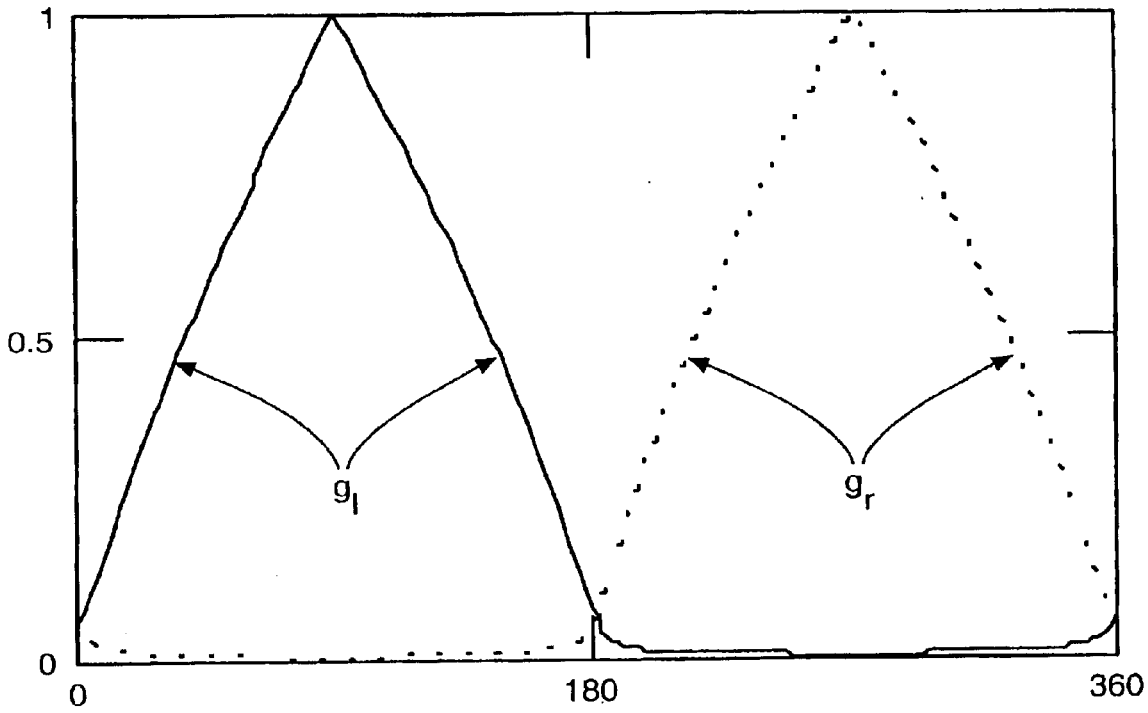
FIG. 7 is an idealized graph, plotting the left and right VCA gains $g_l$ and $g_i$ of the $L_t/R_t$ feedback-derived control system (vertical axis) against the panning angle $\alpha$ (horizontal axis).

Plotting $g_l$ and $g_r$ against the panning angle $\alpha$, one obtains FIG. 7. As might be expected, $g_l$ rises from a very low value at the rear to a maximum of unity when the input represents left only ($\alpha$=90) and then falls back to a low value for the center front ($\alpha$=180). In the right half, $g_l$ remains very small. Similarly and symmetrically, $g_r$ is small except in the middle of the right half of the pan, rising to unity when $\alpha$ is 270 degrees (right only).

Figure 8:
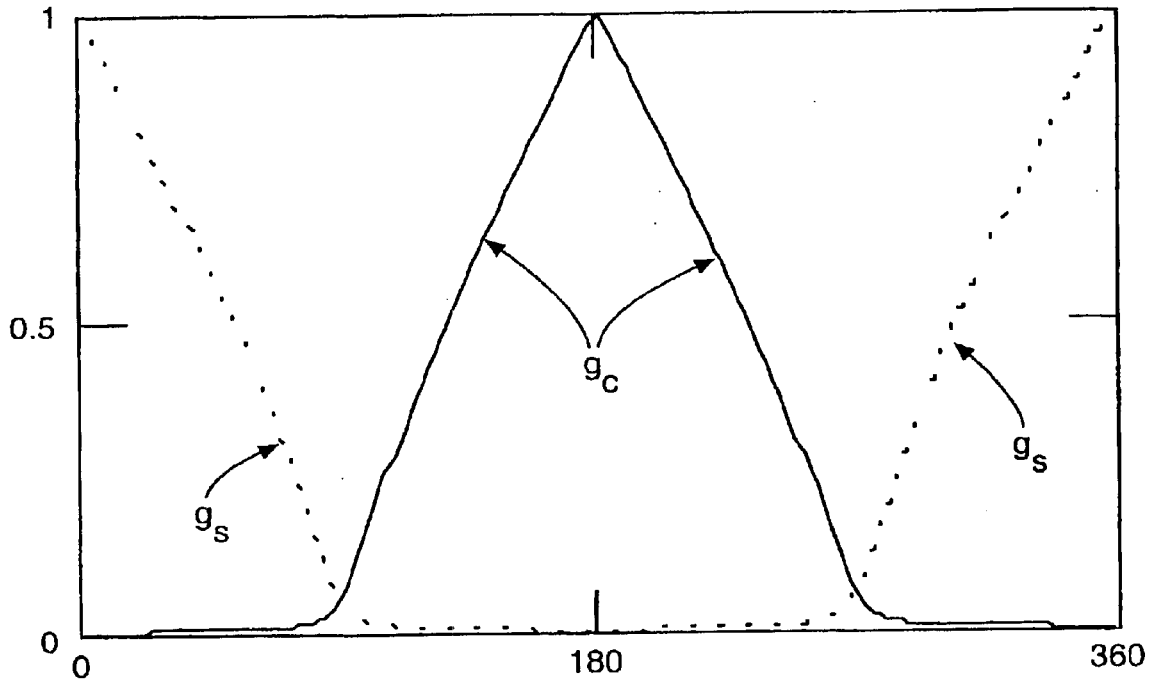
FIG. 8 is an idealized graph, plotting the sum and difference VCA gains $g_c$ and $g_s$ of the sum/difference feedback-derived control system (vertical axis) against the panning angle $\alpha$ (horizontal axis).

The above results are for the $L_t/R_t$ feedback-derived control system. The sum/difference feedback-derived control system acts in exactly the same manner, yielding plots of sum gain $g_c$ and difference gain $g_s$ as shown in FIG. 8. Again, as expected, the sum gain rises to unity at the center front, falling to a low value elsewhere, while the difference gain rises to unity at the rear.

Figure 9:
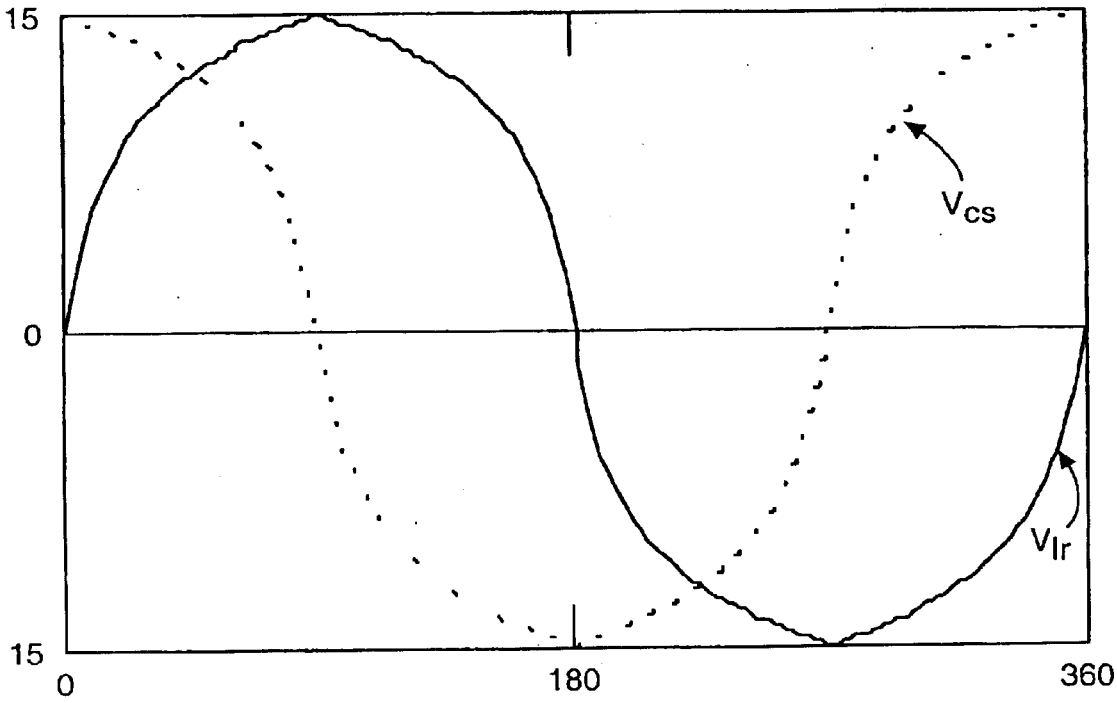
FIG. 9 is an idealized graph, plotting the left/right and the inverted sum/difference control voltages for a scaling in which the maximum and minimum values of control signals are +/−15 volts (vertical axis) against the panning angle $\alpha$ (horizontal axis).

If the feedback-derived control system VCA gains depend on the exponent of the control voltage, as in the preferred embodiment, then the control voltage depends on the logarithm of the gain. Thus, from the equations above, one can derive expressions for the $L_t/R_t$ and sum/difference control voltages, namely, the output of the feedback-derived control system's comparator, comparator 30 of FIG. 3. FIG. 9 shows the left/right and the sum/difference control voltages, the latter inverted (i.e., effectively difference/sum), in an embodiment where the maximum and minimum values of control signals are +/−15 volts. Obviously, other scalings are possible.

The curves in FIG. 9 cross at two points, one where the signals represent an image somewhere to the left back of the listener and the other somewhere in the front half. Due to the symmetries inherent in the curves, these crossing points are exactly half-way between the $\alpha$ values corresponding to adjacent cardinal directions. In FIG. 9, they occur at 45 and 225 degrees.

Figure 10:
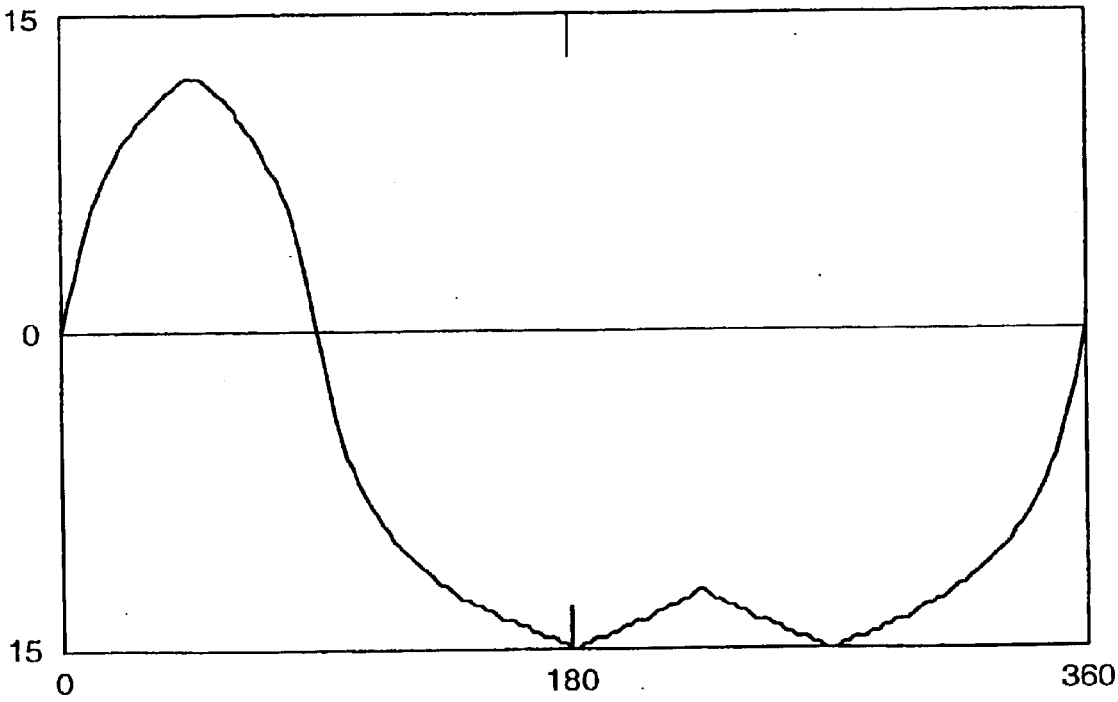
FIG. 10 is an idealized graph, plotting the lesser of the curves in FIG. 9 (vertical axis) against the panning angle $\alpha$ (horizontal axis).

Prior art (e.g., U.S. Pat. No. 5,644,640 of the present inventor James W. Fosgate) shows that it is possible to derive from two main control signals a further control signal that is the greater (more positive) or lesser (less positive) of the two, although that prior art derives the main control signals in a different manner and makes different use of the resultant control signals. FIG. 10 illustrates a signal equal to the lesser of the curves in FIG. 9. This derived control rises to a maximum when $\alpha$ is 45 degrees, that is, the value where the original two curves crossed.

Figure 11:
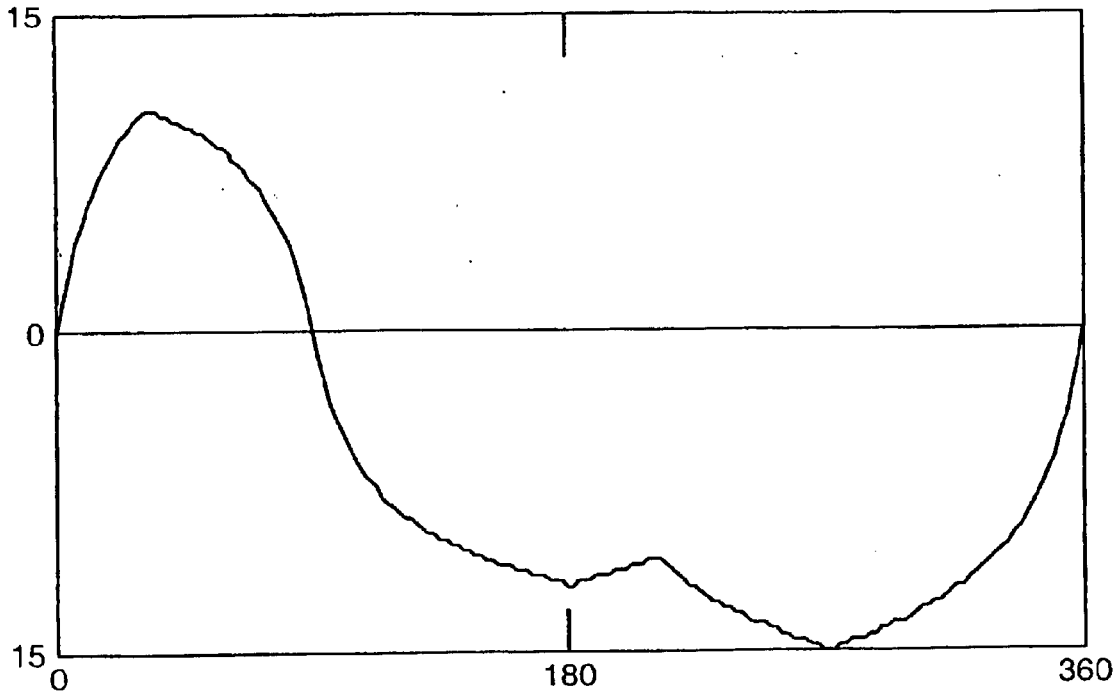
FIG. 11 is an idealized graph, plotting the lesser of the curves in FIG. 9 (vertical axis) against the panning angle $\alpha$ (horizontal axis) for the case in which the sun/difference voltage has been scaled by 0.8 prior to taking the lesser of the curves.

It may not be desirable for the maximum of the derived control signal to rise to its maximum precisely at $\alpha$=45. In practical embodiments, it is preferable for the derived cardinal direction representing left back to be nearer to the back, that is, to have a value that is less than 45 degrees. The precise position of the maximum can be moved by offsetting (adding or subtracting a constant to) or scaling one or both of the left/right and sum/difference control signals so that their curves cross at preferred values of $\alpha$, before taking the more-positive or more-negative function. For instance, FIG. 11 shows the same operation as FIG. 10 except that the sum/difference voltage has been scaled by 0.8, with the result that the maximum now occurs at $\alpha$=31 degrees.

In exactly the same manner, comparing the inverted left/right control with the inverted sum/difference and employing similar offsetting or scaling, a second new control signal can be derived whose maximum occurs in a predetermined position corresponding to the right back of the listener, at a desired and predetermined $\alpha$ (for instance, 360−31 or 329 degrees, 31 degrees the other side of zero, symmetrical with the left back). It is a left/right reversal of FIG. 11.

Figure 12:
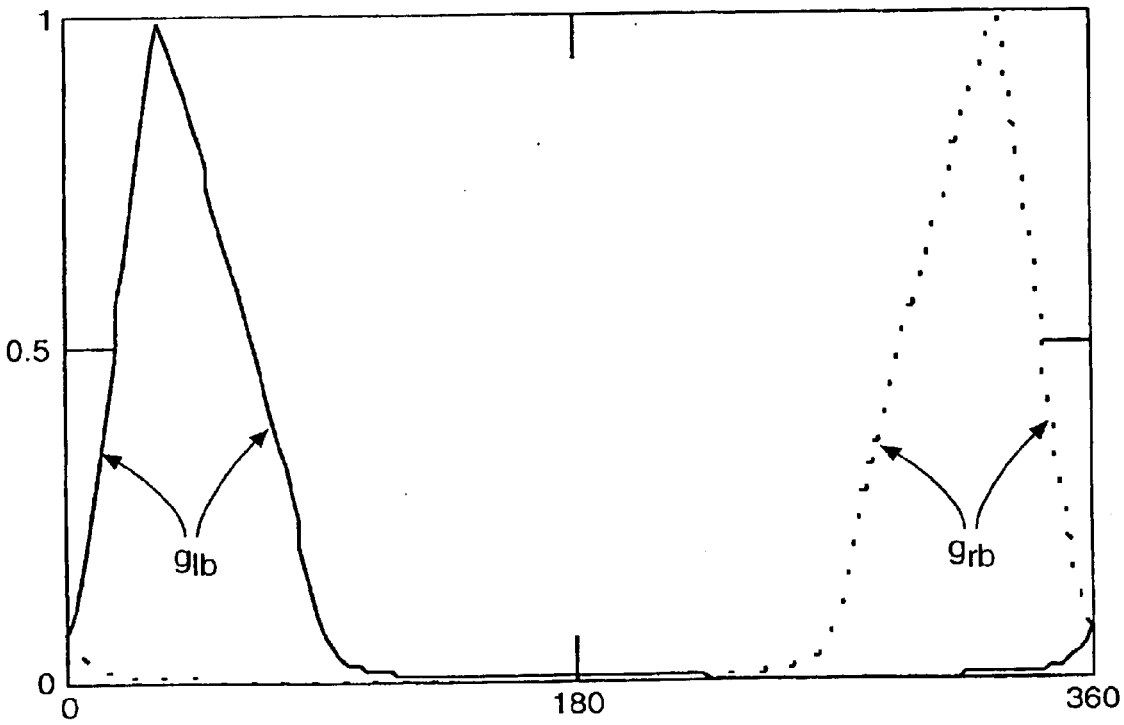
FIG. 12 is an idealized graph, plotting the left back and right back VCA gains $g_{lb}$ and $g_{rb}$ of the left-back/right-back feedback-derived control system (vertical axis) against the panning angle $\alpha$ (horizontal axis).

FIG. 12 shows the effect of applying these derived control signals to VCAs in such a manner that the most positive value gives a gain of unity. Just as the left and right VCAs give gains that rise to unity at the left and right cardinal directions, so these derived left back and right back VCA gains rise to unity when a signal is placed at predetermined places (in this example, $\alpha$=31 degrees either side of zero), but remain very small for all other positions.

Similar results can be obtained with linearly controlled VCAs. The curves for the main control voltages versus panning parameter $\alpha$ will be different, but will cross at points that can be chosen by suitable scaling or offsetting, so further control voltages for specific image positions other than the initial four cardinal directions can be derived by a lesser-than operation. Clearly; it is also possible to invert the control signals and derive new ones by taking the greater (more positive) rather than the lesser (more negative).

The modification of the main control signals to move their crossing point before taking the greater or lesser may alternatively consist of a non-linear operation instead of or in addition to an offset or a scaling. It will be apparent that the modification allows the generation of further control voltages whose maxima lie at almost any desired ratio of the magnitudes and relative polarities of $L_t$ and $R_t$ (the input signals).

An Adaptive Matrix with More than Four Outputs

FIGS. 2 and 4 showed that a passive matrix may have adaptive cancellation terms added to cancel unwanted crosstalk. In those cases, there were four possible cancellation terms derived via four VCAs, and each VCA reached a maximum gain, generally unity, for a source at one of the four cardinal directions and corresponding to a dominant output from one of the four outputs (left, center, right and rear). The system was perfect in the sense that a signal panned between two adjacent cardinal directions yielded little or nothing from outputs other than those corresponding to the two adjacent cardinal outputs.

Figure 13:
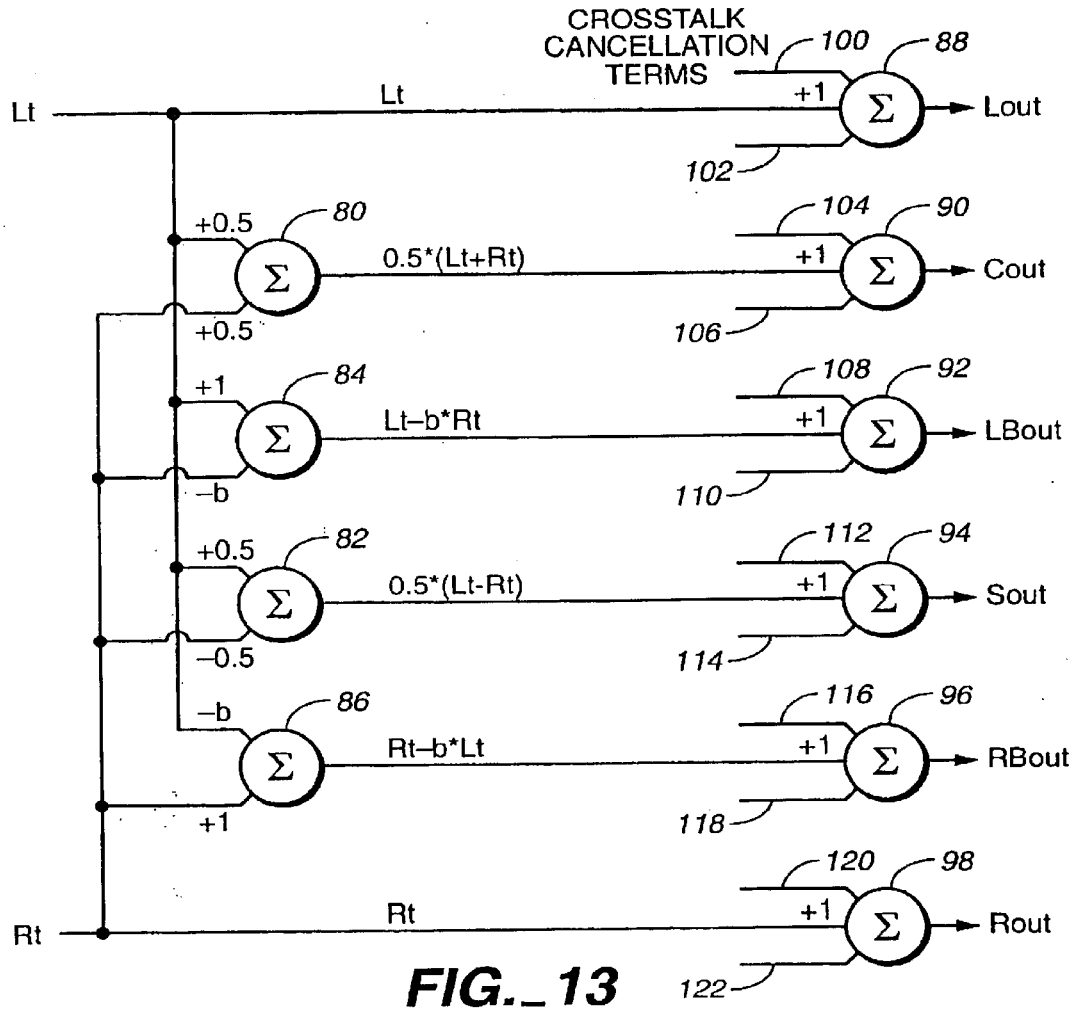
FIG. 13 is a functional and schematic diagram of a portion of an active matrix decoder according to the present invention in which six outputs are obtained.
Figure 14:
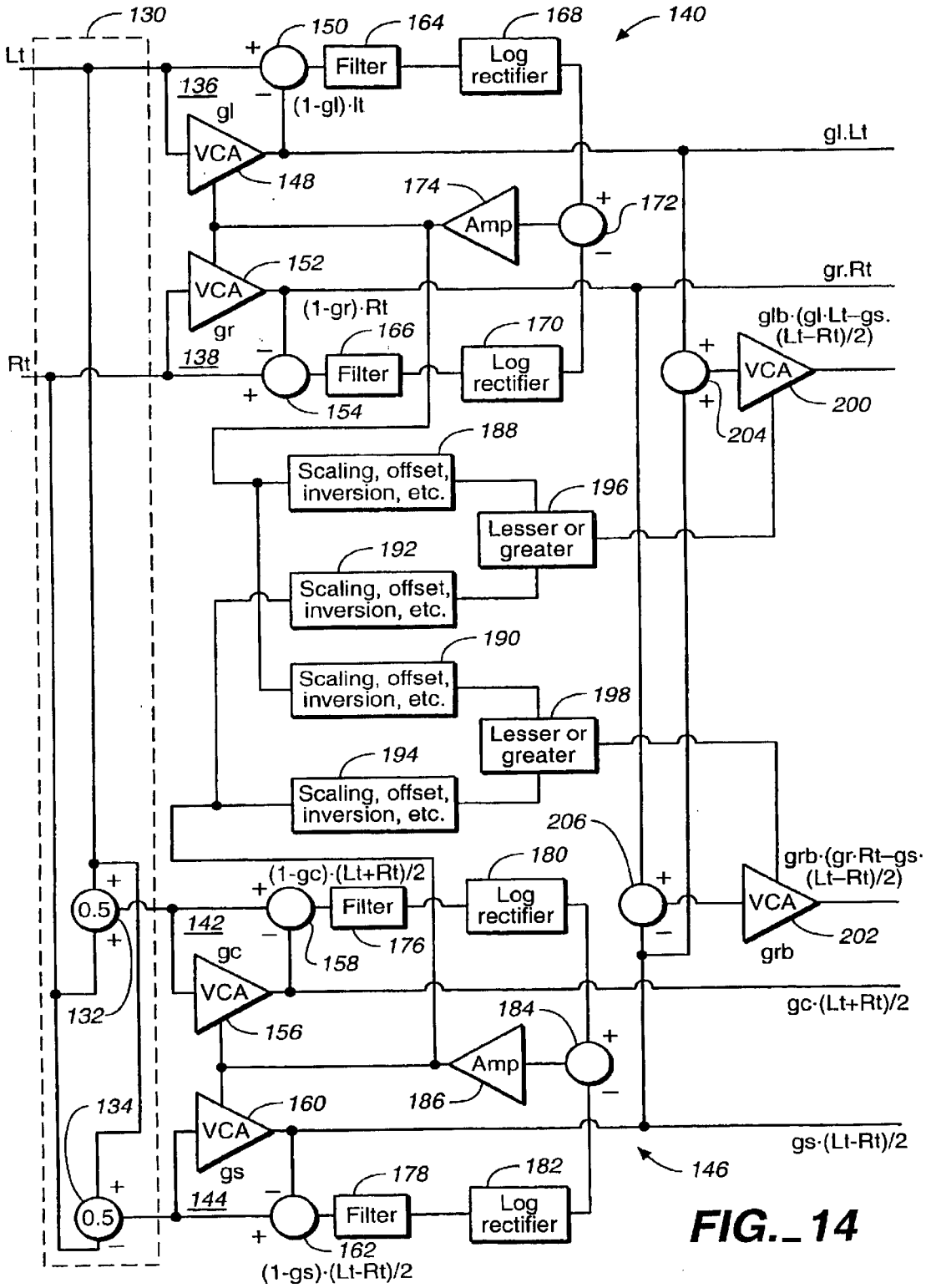
FIG. 14 is a functional and schematic diagram showing the derivation of six cancellation signals for use in a six output active matrix decoder such as that of FIG. 13.

This principle may be extended to active systems with more than four outputs. In such cases, the system is not "perfect," but unwanted signals may still be sufficiently cancelled that the result is audibly unimpaired by crosstalk. See, for example, the six output matrix of FIG. 13. FIG. 13, a functional and schematic diagram of a portion of an active matrix according to the present invention, is a useful aid in explaining the manner in which more than four outputs are obtained. FIG. 14 shows the derivation of six cancellation signals usable in FIG. 13.

Referring first to FIG. 13, there are six outputs: left front ($L_{out}$), center front ($C_{out}$), right front ($R_{out}$), center back (or surround) ($S_{out}$), right back ($RB_{out}$) and left back ($LB_{out}$). For the three front and surround outputs, the initial passive matrix is the same as that of the four-output system described above (a direct $L_t$ input, the combination of $L_t$ plus $R_t$ scaled by one-half and applied to a linear combiner 80 to yield center front, the combination of $L_t$ minus $R_t$ scaled by one-half and applied to a linear combiner 82 to yield center back, and a direct $R_t$ input). There are two additional back outputs, left back and rear back, resulting from applying $L_t$ with a scaling of 1 and $R_t$ with a scaling of −b to a linear combiner 84 and applying $L_t$ with a scaling of −b and $R_t$ with a scaling of 1 to a linear combiner 86, corresponding to different combinations of the inputs in accordance with the equations $LB_{out}=L_t-b*R_t$ and $RB_{out}=R_t-b*L_t$. Here, b is a positive coefficient typically less than 1, for example, 0.25. Note the symmetry that is not essential to the invention but would be expected in any practical system.

In FIG. 13, in addition to the passive matrix terms, the output linear combiners (88, 90, 92, 94, 96 and 98) receive multiple active cancellation terms (on lines 100, 102, 104, 106, 108, 110, 112, 114, 116, 118, 120 and 122) as required to cancel the passive matrix outputs. These terms consist of the inputs and/or combinations of the inputs multiplied by the gains of VCAs (not shown) or combinations of the inputs and the inputs multiplied by the gains of VCAs. As described above, the VCAs are controlled so that their gains rise to unity for a cardinal input condition and are substantially smaller for other conditions.

The configuration of FIG. 13 has six cardinal directions, provided by inputs $L_t$ and $R_t$ in defined relative magnitudes and polarities, each of which should result in signals from the appropriate output only, with substantial cancellation of signals in the other five outputs. For an input condition representing a signal panned between two adjacent cardinal directions, the outputs corresponding to those cardinal directions should deliver signals but the remaining outputs should deliver little or nothing. Thus, one expects that for each output, in addition to the passive matrix there will be several cancellation terms (in practice, more than the two shown in FIG. 13), each corresponding to the undesired output for an input corresponding to each of the other cardinal directions. In practice, the arrangement of FIG. 13 may be modified to eliminate the center back $S_{out}$ output (thus eliminating combiners 82 and 94) so that center back is merely a pan half-way between left back and right back rather than a sixth cardinal direction.

For either the six-output system of FIG. 13 or its five-output alternative there are six possible cancellation signals: the four derived via the two pairs of VCAs that are parts of the left/right and sum/difference feedback-derived control systems and two more derived via left back and right back VCAs controlled as described above (see also the embodiment of FIG. 14, described below). The gains of the six VCAs are in accordance with FIG. 7 ($g_l$ left and $g_r$ right), FIG. 8 ($g_c$ sum and $g_s$ difference) and FIG. 12 ($g_{lb}$ left back and $g_{rb}$ right back). The cancellation signals are summed with the passive matrix terms using coefficients calculated or otherwise chosen to minimize unwanted crosstalk, as described below.

One arrives at the required cancellation mixing coefficients for each cardinal output by considering the input signals and VCA gains for every other cardinal direction, remembering that those VCA gains rise to unity only for signals at the corresponding cardinal direction, and fall away from unity fairly rapidly as the image moves away.

Thus, for instance, in the case of the left output, one needs to consider the signal conditions for center front, right only, right back, center back (not a real cardinal direction in the five-output case) and left back.

Consider in detail the left output, $L_{out}$ for the five-output modification of FIG. 13. It contains the term from the passive matrix, $L_t$. To cancel the output when the input is in the center, when $L_t=R_t$ and $g_c=1$, one needs the term $-\frac{1}{2}*g_c*(L_t+R_t)$, exactly as in the four-output system of FIG. 2 or 4. To cancel when the input is at center back or anywhere between center back and right front (therefore including right back), one needs $-\frac{1}{2}*g_s*(L_t-R_t)$, again exactly as in the four-output system of FIG. 2 or 4. To cancel when the input represents left back, one needs a signal from the left back VCA whose gain $g_{lb}$ varies as in FIG. 12. This can clearly deliver a significant cancellation signal only when the input lies in the region of left back. Since the left back can be considered as somewhere between left front, represented by $L_t$ only, and center back, represented by $\frac{1}{2}*(L_t-R_t)$, it is to be expected that the left back VCA should operate on a combination of those signals.

Various fixed combinations can be used, but by using a sum of the signals that have already passed through the left and difference VCAs, i.e., $g_l,L_t$ and $\frac{1}{2}*g_s*(L_t-R_t)$, the combination varies in accordance with the position of signals panned in the region of, but not exactly at, left back, providing better cancellation for those pans as well as the cardinal left back itself. Note that at this left back position, which can be considered as intermediate between left and rear, both $g_l$ and $g_s$ have finite values less than unity. Hence the expected equation for $L_{out}$ will be:

$$L_{out}=[L_t]-\tfrac{1}{2}*g_c*(L_t+R_t)-\tfrac{1}{2}*g_s*(L_t-R_t)-x*g_{lb}*((g_l*L_t+g_s*\tfrac{1}{2}*(L_t-R_t)) \quad \text{(Eqn. 21)}$$

The coefficient x can be derived empirically or from a consideration of the precise VCA gains when a source is in the region of the left back cardinal direction. The term $[L_t]$ is the passive matrix term. The terms $\frac{1}{2}*g_c*(L_t+R_t)$, $-\frac{1}{2}*g_s*(L_t-R_t)$, and $\frac{1}{2}*x*g_{lb}*((g_l*L_t+g_s*\frac{1}{2}*(L_t-R_t))$ represent cancellation terms (see FIG. 14) that may be combined with $L_t$ in linear combiner 88 (FIG. 13) in order to derive the output audio signal $L_{out}$. As explained above, there may be more than two crosstalk cancellation term inputs than the two (100 and 102) shown in FIG. 13.

The equation for $R_{out}$ is derived similarly, or by symmetry:

$$R_{out}=[R_t]-\tfrac{1}{2}*g_c*(L_t+R_t)+\tfrac{1}{2}*g_s*(L_t-R_t)-\tfrac{1}{2}*x*g_{rb}*((g_r*R_t-g_s*(L_t-R_t)) \quad \text{(Eqn. 22)}$$

The term $[R_t]$ is the passive matrix term. The terms $-\frac{1}{2}*g_c*(L_t+R_t)$, $\frac{1}{2}*g_s*(L_t-R_t)$, and $-\frac{1}{2}*x*g_{rb}*((g_r*R_t-g_s*(L_t-R_t))$ represent cancellation terms (see FIG. 14) that may be combined with $R_t$ in linear combiner 98 (FIG. 13) in order to derive the output audio signal $R_{out}$. As explained above, there may be more than two crosstalk cancellation term inputs than the two (120 and 122) shown in FIG. 13.

The center front output, $C_{out}$, contains the passive matrix term $\frac{1}{2}*(L_t+R_t)$, plus the left and right cancellation terms as for the four-output system, $-\frac{1}{2}*g_l*L_t$ and $-\frac{1}{2}*g_r*R_t$:

$$C_{out}=[\tfrac{1}{2}(L_t+R_t)]-\tfrac{1}{2}*g_l*L_t*-\tfrac{1}{2}*g_r*R_t* \quad \text{(Eqn. 23)}$$

There is no need for explicit cancellation terms for the left back, center back or right back since they are effectively pans between left and right front via the back (surround, in the four-output) and already cancelled. The term $[\frac{1}{2}(L_t+R_t)]$ is the passive matrix term. The terms $-\frac{1}{2}*g_l*L_t$ and $-\frac{1}{2}*g_r*R_t$ represent cancellation terms (see FIG. 14) that may be applied to inputs 100 and 102 and combined with a scaled version of $L_t$ and $R_t$ in linear combiner 90 (FIG. 13) in order to derive the output audio signal $C_{out}$.

For the left back output, the starting passive matrix, as stated above, is $L_t-b*R_t$. For a left only input, when $g_l=1$, clearly the required cancellation term is therefore $-g_l*L_t$. For a right only input, when $g_r=1$, the cancellation term is $+b*g_r*R_t$. For a center front input, where $L_t=R_t$ and $g_c=1$, the unwanted output from the passive terms, $L_t-b*R_t$, can be cancelled by $(1-b)*g_c*\frac{1}{2}*(L_t+R_t)$. The right back cancellation term is $-g_{rb}*(g_r*R_t-\frac{1}{2}*g_s*(L_t-R_t))$, the same as the term used for $R_{out}$, with an optimized coefficient y, which may again be arrived at empirically or calculated from the VCA gains in the left or right back conditions. Thus, $$LB_{out}=[Lt-b*R_t]-g_l*L_t+b*gr*R_t-(1-b)*g_c*\tfrac{1}{2}*(Lt+Rt)-y*g_{rb}*(g_r*R_t-g_s*\tfrac{1}{2}*(L_t-R_t)) \quad \text{(Eqn. 24)}$$

Similarly, $$RB_{out}=[R_t-b*L_t]-g_r*R_t+b*g_l*L_t-(1-b)*g_c*\tfrac{1}{2}*(L_t+R_t)-y*g_{lb}*(g_l*L_t+g_s*\tfrac{1}{2}*(L_t-R_t)) \quad \text{(Eqn. 25)}$$

With respect to equation 24, the term $[L_t-b*R_t]$ is the passive matrix term and the terms $-g_l*L_t$, $+b*g_r*R_t$, $-\frac{1}{2}*(1-b)*g_c*(L_t+R_t)$ and $-y*grb*((gr*Rt-gs*\frac{1}{2}*(Lt-Rt))$ represent cancellation terms (see FIG. 14) that may be combined with $L_t-bR_t$ in linear combiner 92 (FIG. 13) in order to derive the output audio signal $LB_{out}$. As explained above, there may be more than two crosstalk cancellation term inputs, than the two (108 and 110) shown in FIG. 13.

With respect to equation 25, the $[R_t-b*L_t]$ is the passive matrix term and the components $-g_r*R_t$, $b*L_t*g_l$, $-\frac{1}{2}*(1-b)*g_c*(L_t+R_t)$, and $-y*g_{lb}*((g_l*L_t+g_s*\frac{1}{2}*(L_t-R_t)$ represent cancellation terms (see FIG. 14) that may be combined with $R_t-b*L_t$ in linear combiner 96 (FIG. 13) in order to derive the output audio signal $RB_{out}$. As explained above, there may be more than two crosstalk cancellation term inputs than the two (116 and 118) shown in FIG. 13.

In practice, all the coefficients may need adjustments to compensate for the finite loop-gains and other imperfections of the feedback-derived control systems, which do not deliver precisely equal signal levels, and other combinations of the six cancellation signals may be employed.

These principles can, of course, be extended to embodiments having more than five or six outputs. Yet additional control signals can be derived by further application of the scaling, offsetting or non-linear processing of the two main control signals from the left/right and sum/difference feedback portions of the feedback-derived control systems, permitting the generation of additional cancellation signals via VCAs whose gains rise to maxima at other desired predetermined values of $\alpha$. The synthesis process of considering each output in the presence of signals at each of the other cardinal directions in turn will yield appropriate terms and coefficients for generating additional outputs.

Referring now to FIG. 14, input signals Lt and Rt are applied to a passive matrix 130 that produces a left matrix signal output from the $L_t$ input, a right matrix signal output from the $R_t$ input, a center output from a linear combiner 132 whose input is $L_t$ and $R_t$, each with a scale factor of +½, and a surround output from a linear combiner 134 whose input is $L_t$ and $R_t$ with scale factors of +½ and −½, respectively. The cardinal directions of the passive matrix are designated "left," "center," "right," and "surround." Adjacent cardinal directions lie on mutually orthogonal axes, such that, for these direction labels, left is adjacent to center and surround; surround is adjacent to left and right, etc.

The left and right passive matrix signals are applied to a first pair of variable gain circuits 136 and 138 and associated feedback-derived control system 140. The center and surround passive matrix signals are applied to a second pair of variable gain circuits 142 and 144 and associated feedback-derived control system 146.

The "left" variable gain circuit 136 includes a voltage controlled amplifier (VCA) 148 having a gain $g_l$ and a linear combiner 150. The VCA output is subtracted from the left passive matrix signal in combiner 150 so that the overall gain of the variable gain circuit is $(1-g_l)$ and the output of the variable gain circuit at the combiner output, constituting an intermediate signal, is $(1-g_l)*L_t$. The VCA 148 output signal, constituting a cancellation signal, is $g_l*L_t$ The "right" variable gain circuit 138 includes a voltage controlled amplifier (VCA) 152 having a gain $g_r$ and a linear combiner 154. The VCA output is subtracted from the right passive matrix signal in combiner 154 so that the overall gain of the variable gain circuit is $(1-g_r)$ and the output of the variable gain circuit at the combiner output, constituting an intermediate signal, is $(1-g_r)*R_t$. The VCA 152 output signal $g_r*R_t$ constitutes a cancellation signal. The $(1-g_r)*R_t$ and $(1-g_l)*L_t$ intermediate signals constitute a first pair of intermediate signals. It is desired that the relative magnitudes of this first pair of intermediate signals be urged toward equality. This is accomplished by the associated feedback-derived control system 140, described below.

The "center" variable gain circuit 142 includes a voltage controlled amplifier (VCA) 156 having a gain $g_c$ and a linear combiner 158. The VCA output is subtracted from the center passive matrix signal in combiner 158 so that the overall gain of the variable gain circuit is $(1-g_c)$ and the output of the variable gain circuit at the combiner output, constituting an intermediate signal, is $½*(1-g_c)*(L_t+R_t)$. The VCA 156 output signal $½*g_c*(L_t+R_t)$ constitutes a cancellation signal.

The "surround" variable gain circuit 144 includes a voltage controlled amplifier (VCA) 160 having a gain $g_r$ and a linear combiner 162. The VCA output is subtracted from the surround passive matrix signal in combiner 162 so that the overall gain of the variable gain circuit is $(1-g_s)$ and the output of the variable gain circuit at the combiner output, constituting an intermediate signal, is $½*(1-g_s)*(L_t-R_t)$. The VCA 160 output signal $½*g_s)*(L_t-R_t)$ constitutes a cancellation signal. The $½*(1-g_c)*(L_t+R_t)$ and $½*(1-g_s)*(L_t-R_t)$ intermediate signals constitute a second pair of intermediate signals. It is also desired that the relative magnitudes of this second pair of intermediate signals be urged toward equality. This is accomplished by the associated feedback-derived control system 146, described below.

The feedback-derived control system 140 associated with the first pair of intermediate signals includes filters 164 and 166 receiving the outputs of combiners 150 and 154, respectively. The respective filter outputs are applied to log rectifiers 168 and 170 that rectify and produce the logarithm of their inputs. The rectified and logged outputs are applied with opposite polarities to a linear combiner 172 whose output, constituting a subtraction of its inputs, is applied to a non-inverting amplifier 174 (devices 172 and 174 correspond to the magnitude comparator 30 of FIG. 3). Subtracting the logged signals provides a comparison function. As mentioned above, this is a practical way to implement a comparison function in the analog domain. In this case, VCAs 148 and 152 are of the type that inherently take the antilog of their control inputs, thus taking the antilog of the control output of the logarithmically-based comparator. The output of amplifier 174 constitutes a control signal for VCAs 148 and 152. As mentioned above, if implemented digitally, it may be more convenient to divide the two magnitudes and use the resultants as direct multipliers for the VCA functions. As noted above, the filters 164 and 166 may be derived empirically, providing a response that attenuates low frequencies and very high frequencies and provides a gently rising response over the middle of the audible range. These filters do not alter the frequency response of the output signals, they merely alter the control signals and VCA gains in the feedback-derived control systems.

The feedback-derived control system 146 associated with the second pair of intermediate signals includes filters 176 and 178 receiving the outputs of VCAs 158 and 162, respectively. The respective filter outputs are applied to log rectifiers 180 and 182 that rectify and produce the logarithm of their inputs. The rectified and logged outputs are applied with opposite polarities to a linear combiner 184 whose output, constituting a subtraction of its inputs, is applied to a non-inverting amplifier 186 (devices 184 and 186 correspond to the magnitude comparator 30 of FIG. 3). The feedback-derived control system 146 operates in the same manner as control system 140. The output of amplifier 186 constitutes a control signal for VCAs 158 and 162.

Additional control signals are derived from the control signals of feedback-derived control systems 140 and 146. The control signal of control system 140 is applied to first and second scaling, offset, inversion, etc. functions 188 and 190. The control signal of control system 146 is applied to first and second scaling, offset, inversion, etc. functions 192 and 194. Functions 188, 190, 192 and 194 may include one or more of the polarity inverting, amplitude offsetting, amplitude scaling and/or non-linearly processing described above. Also in accordance with descriptions above, the lesser or the greater of the outputs of functions 188 and 192 and of functions 190 and 194 are taken in by lesser or greater functions 196 and 198, respectively, in order to produce additional control signals that are applied to a left back VCA 200 and a right back VCA 202, respectively. In this case, the additional control signals are derived in the manner described above in order to provide control signals suitable for generating a left back cancellation signal and a right back cancellation signal. The input to left back VCA 200 is obtained by additively combining the left and surround cancellation signals in a linear combiner 204. The input to right back VCA 202 is obtained by subtractively combining the right and surround cancellation signals in a linear combiner 204. Alternatively and less preferably, the inputs to the VCAs 200 and 202 may be derived from the left and surround passive matrix outputs and from the right and surround passive matrix output, respectively. The output of left back VCA 200 is the left back cancellation signal $g_{lb}*½*((g_l*L_t+g_s(L_t-R_t))$. The output of right back VCA 202 is the right back cancellation signal $g_{rb}*½*((g_r*R_t+g_s(L_t-R_t))$.

Figures 15, 15A, 15B, 15C, 15D, 15E, 15F, 15G, 15H, 15I, 15J, 15K, 15L, 15M, 15N, 15O, 15P:
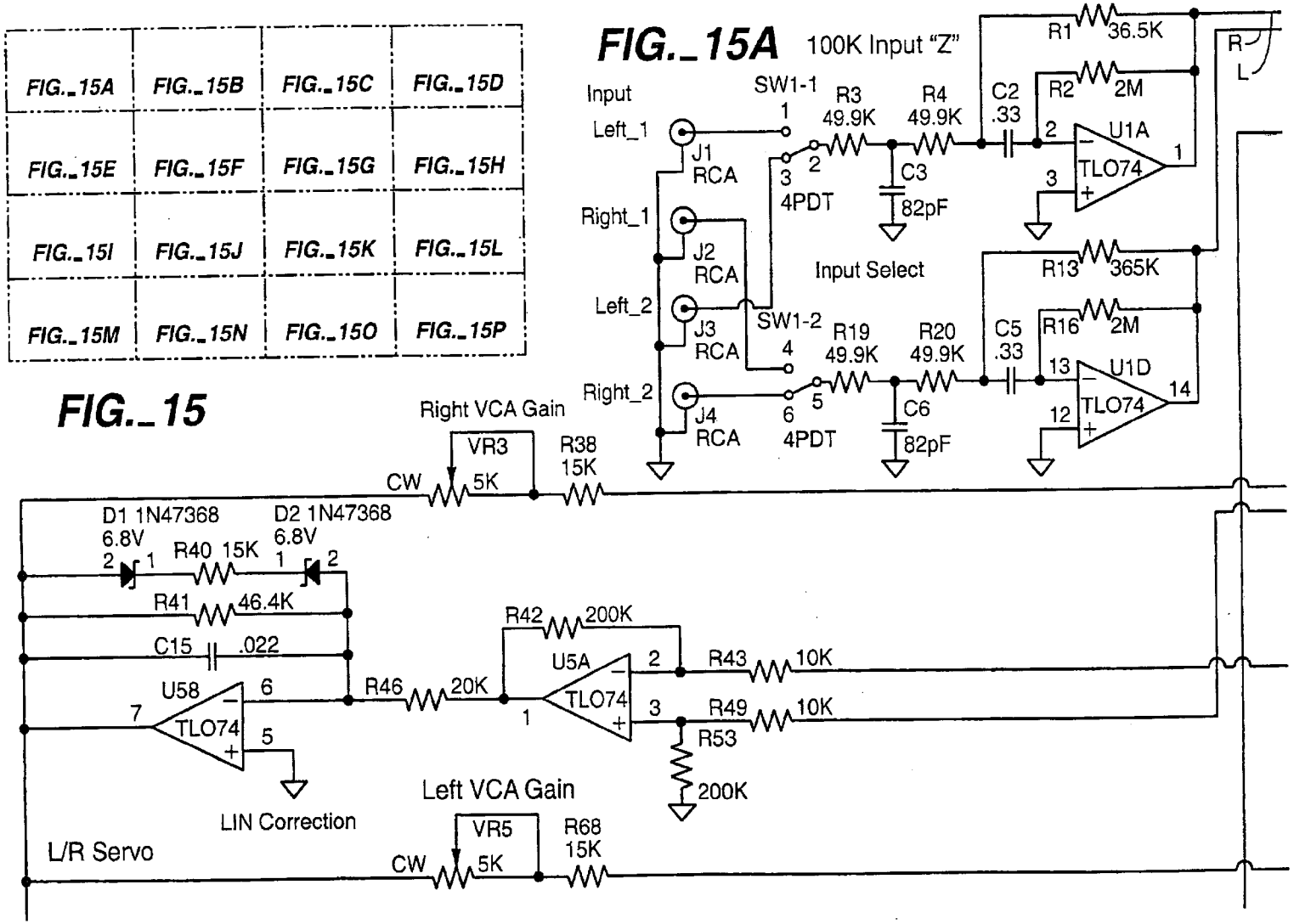
FIG. 15 is a schematic circuit diagram showing a practical circuit embodying aspects of the present invention.
Figure 15B:
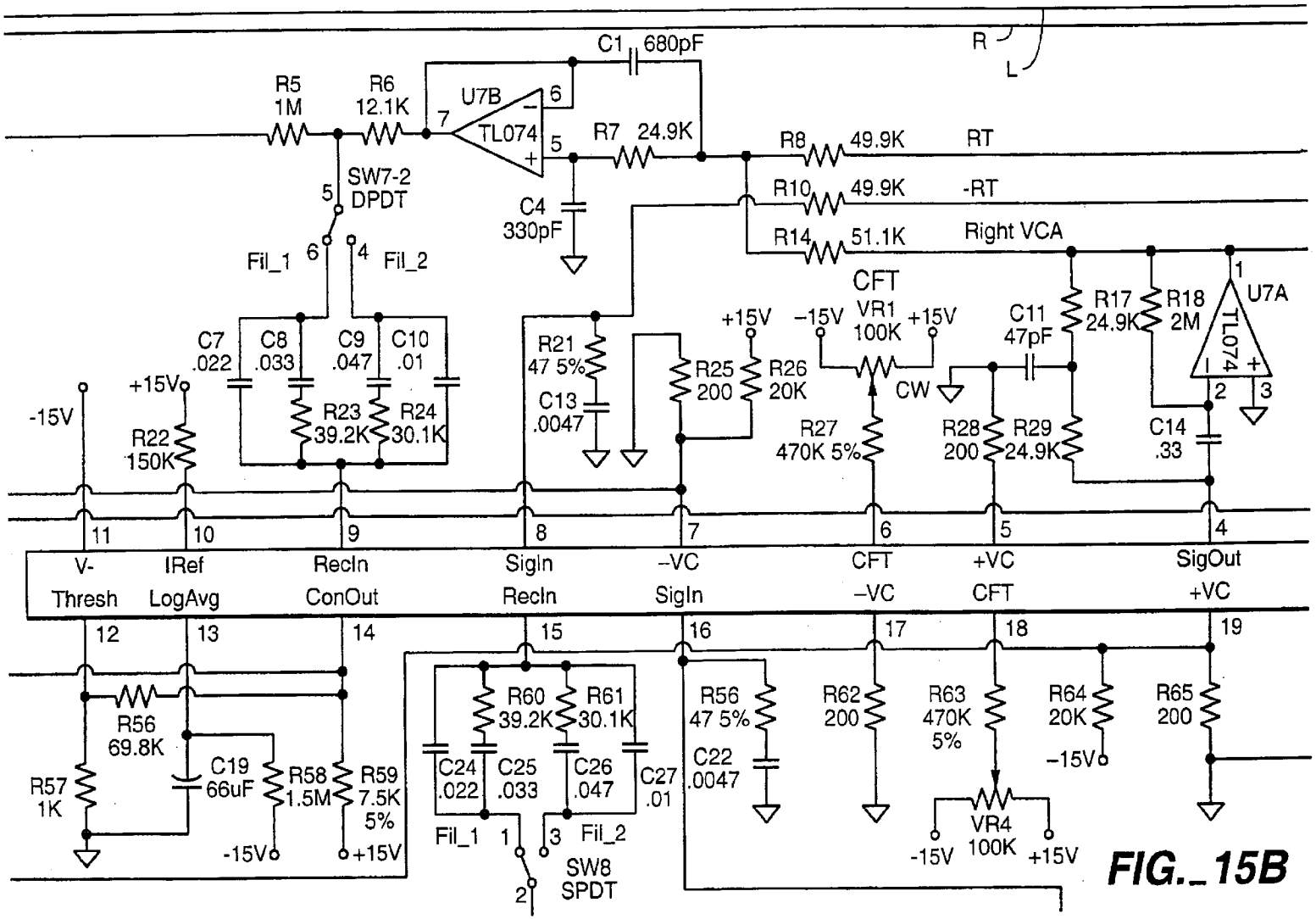
Figure 15C:
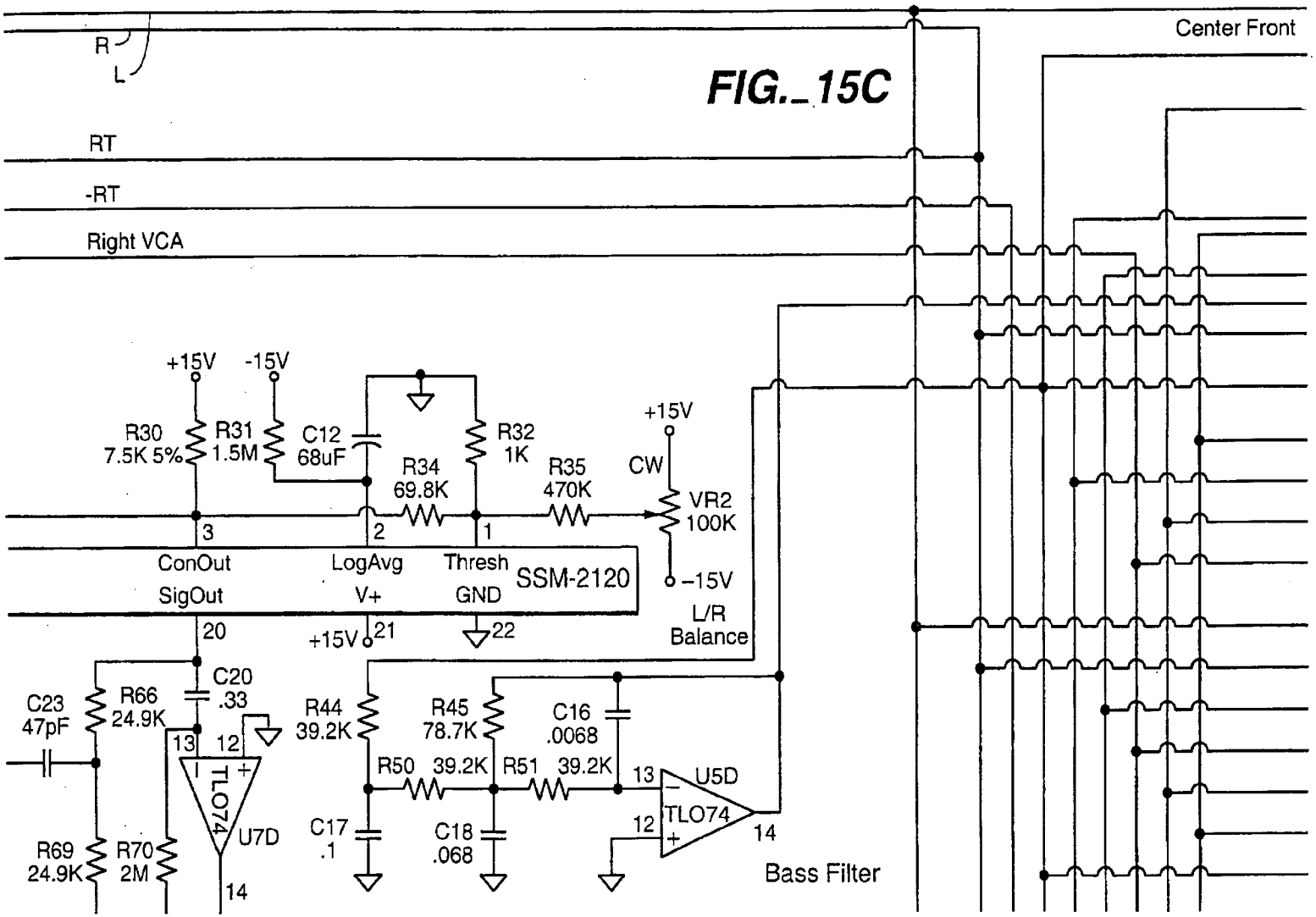
Figure 15D:
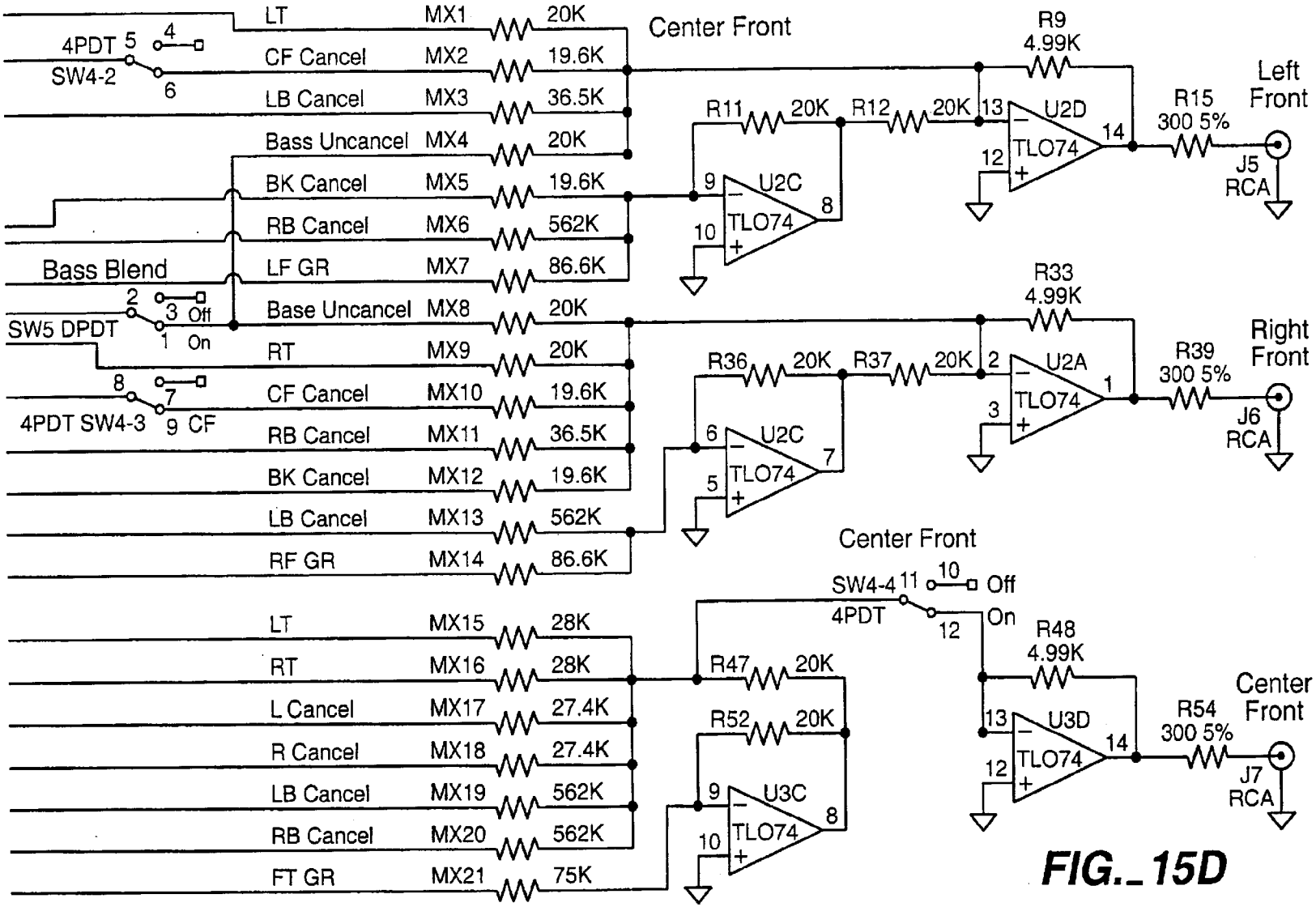
Figure 15E:
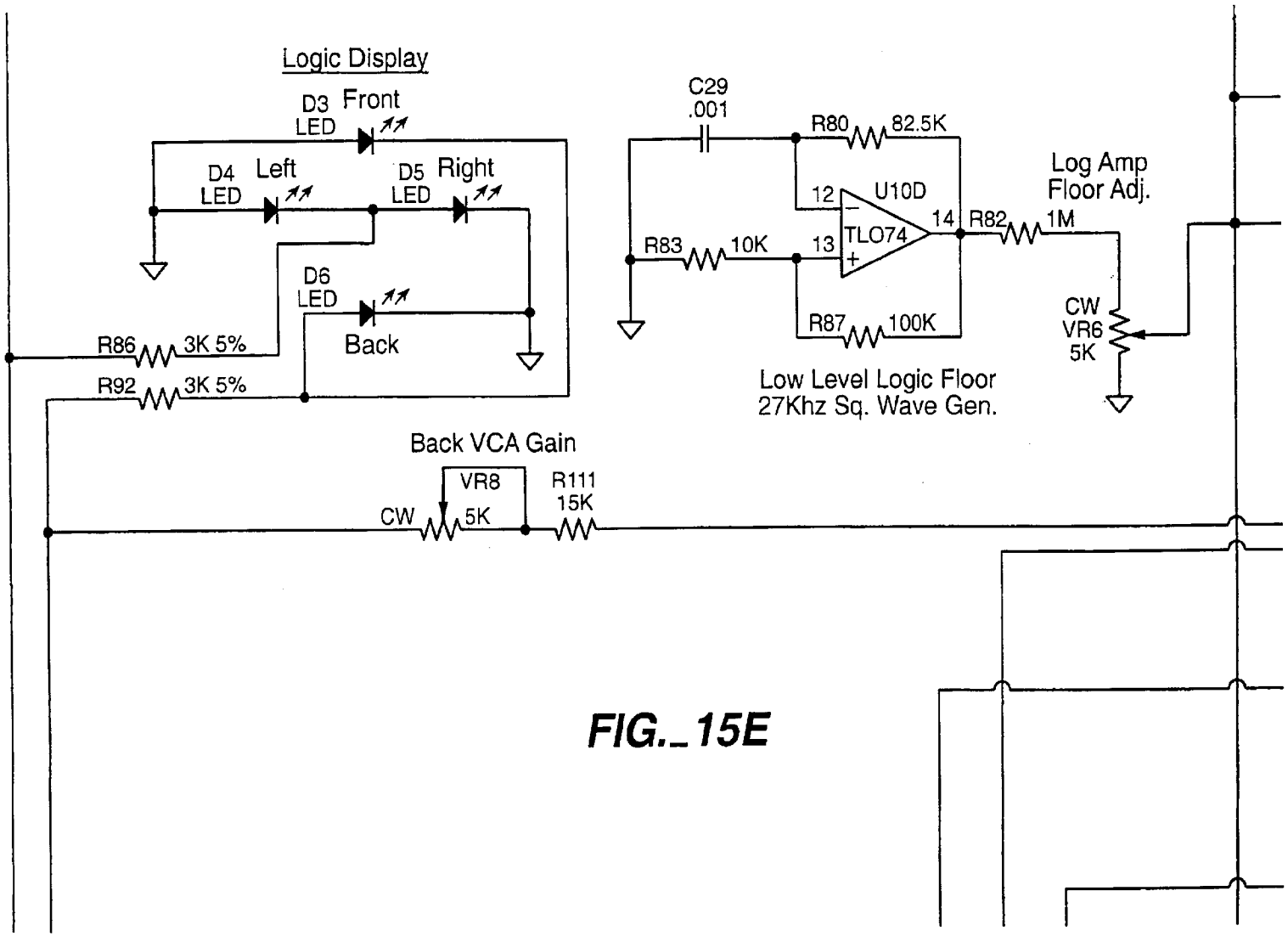
Figure 15F:
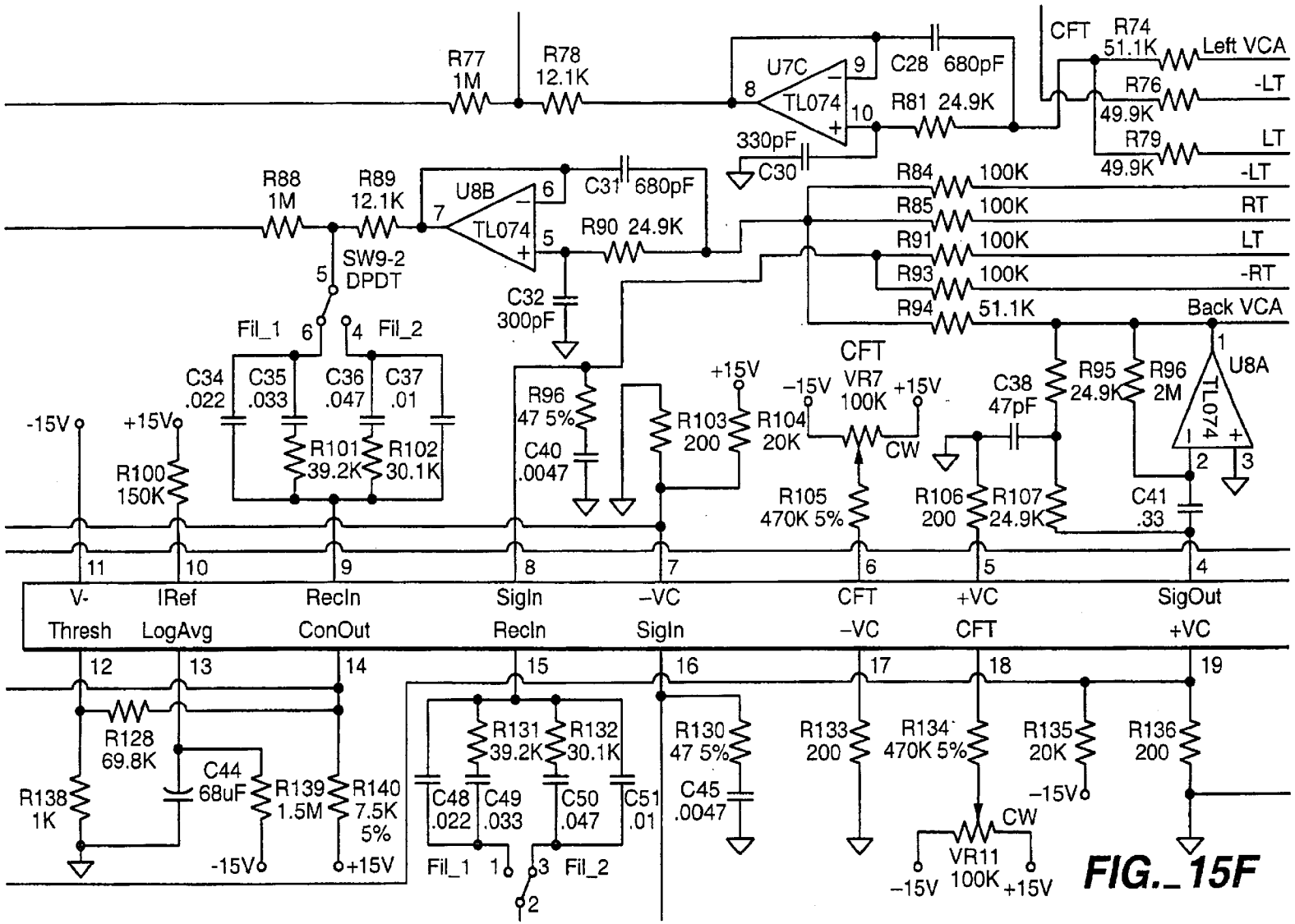
Figure 15G:
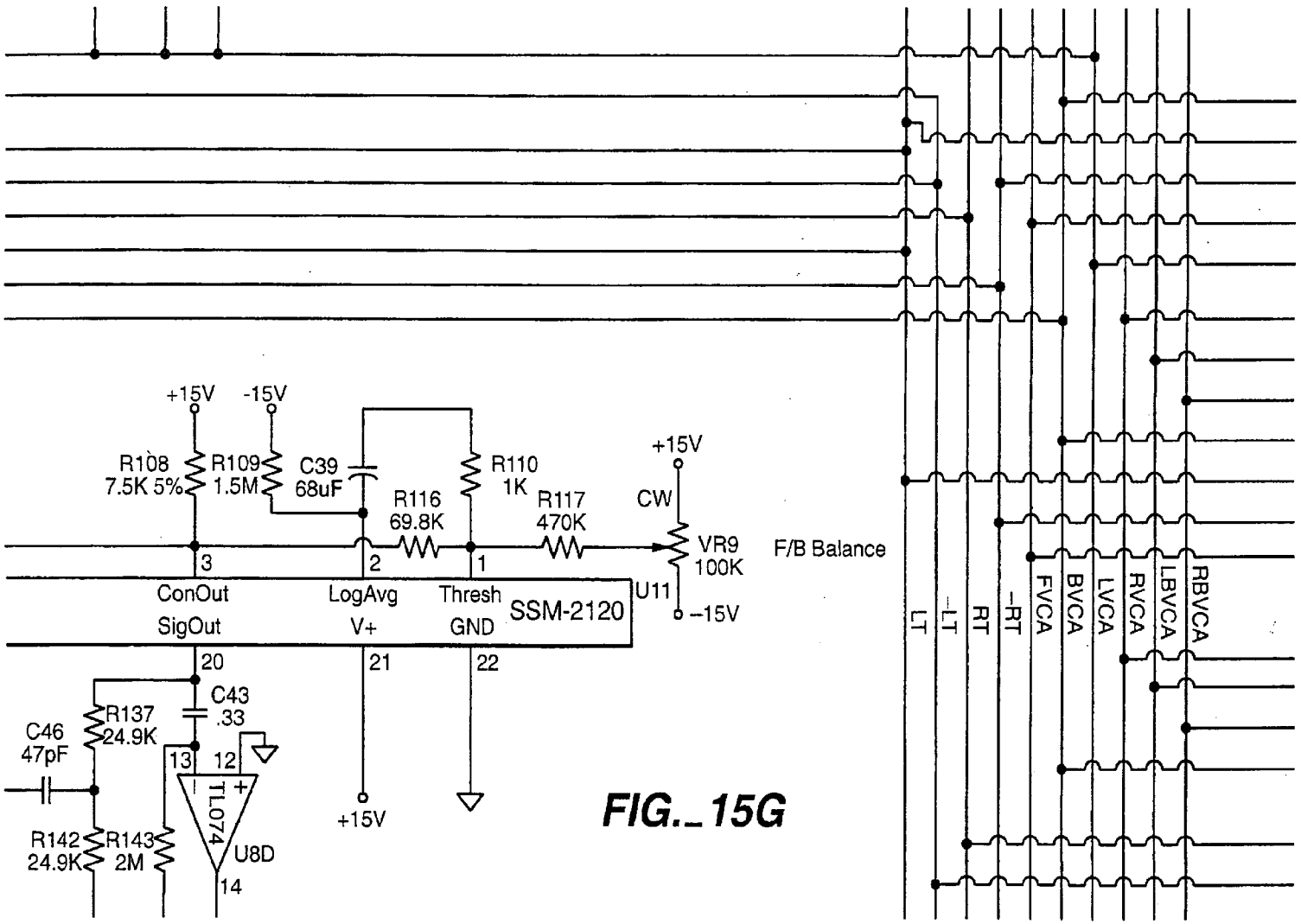
Figure 15H:
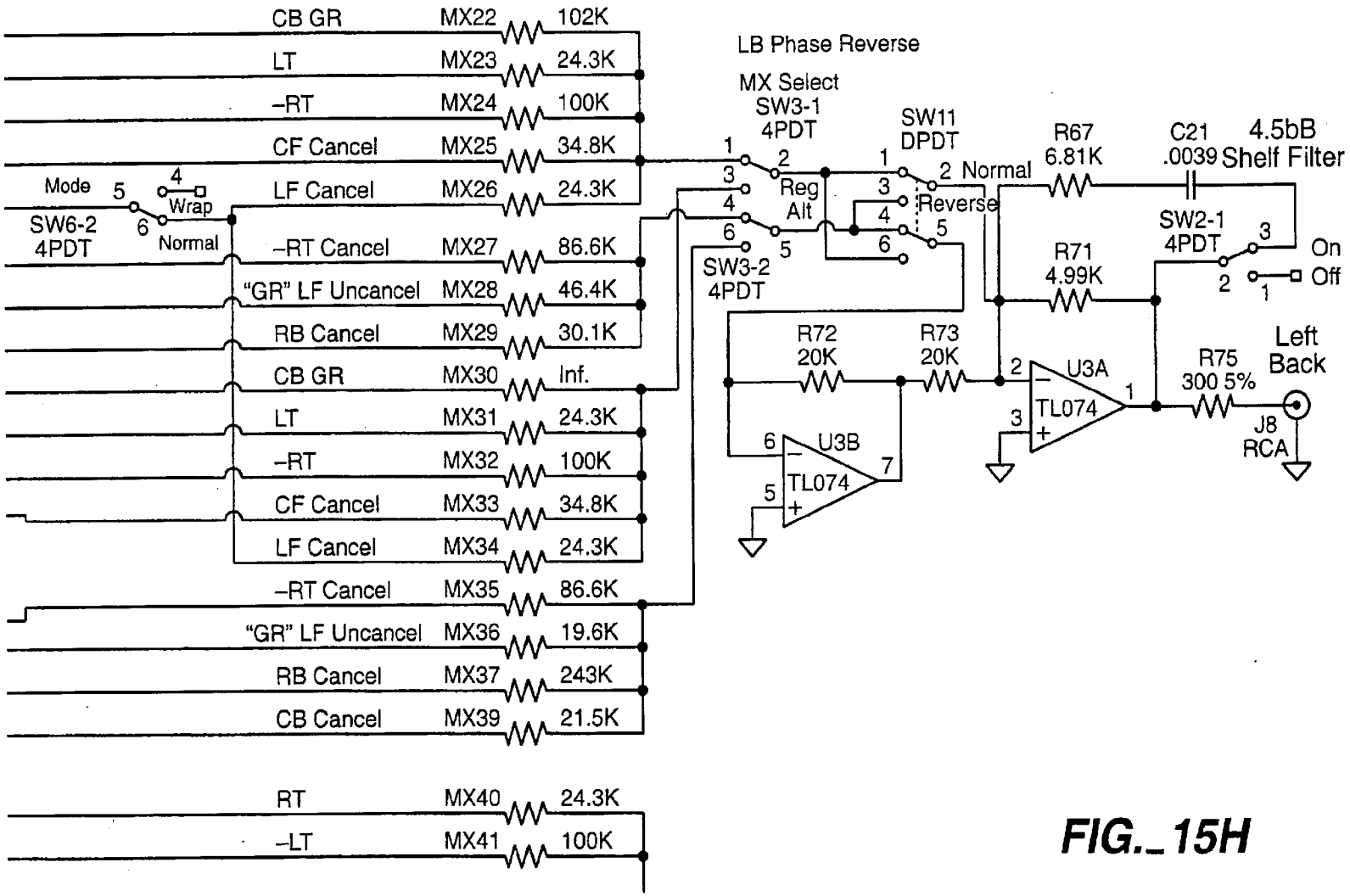
Figure 15I:
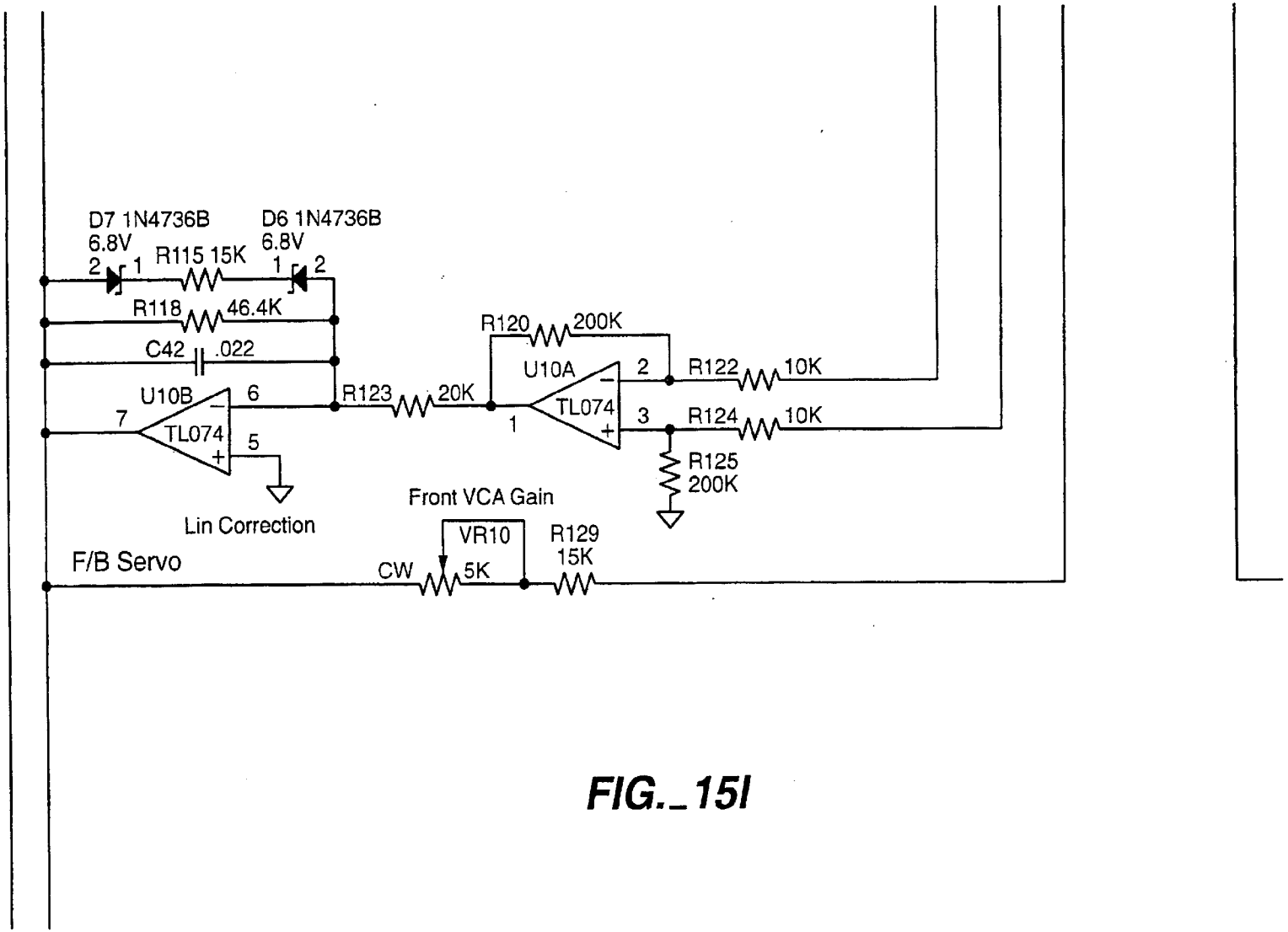
Figure 15J:
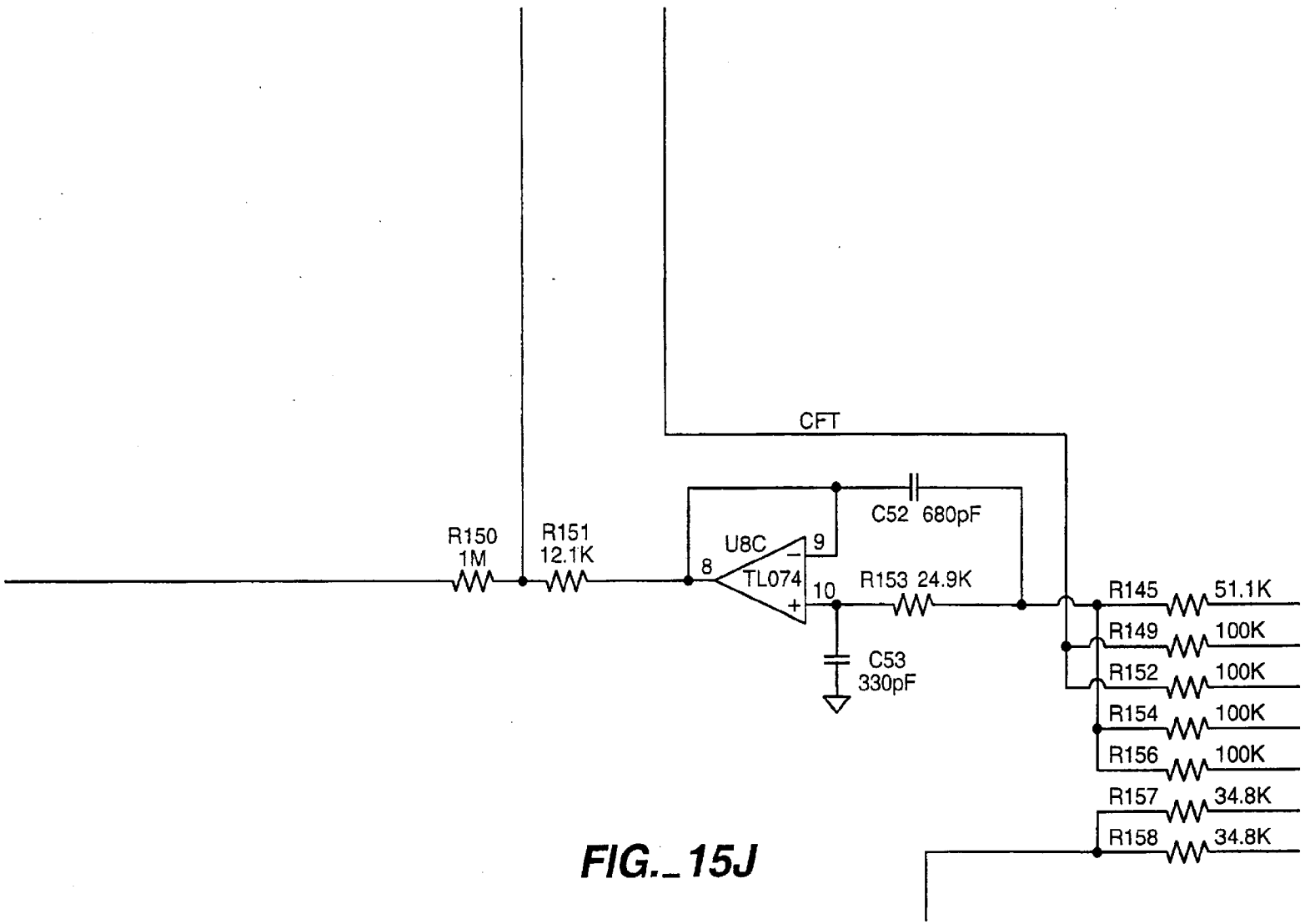
Figure 15K:
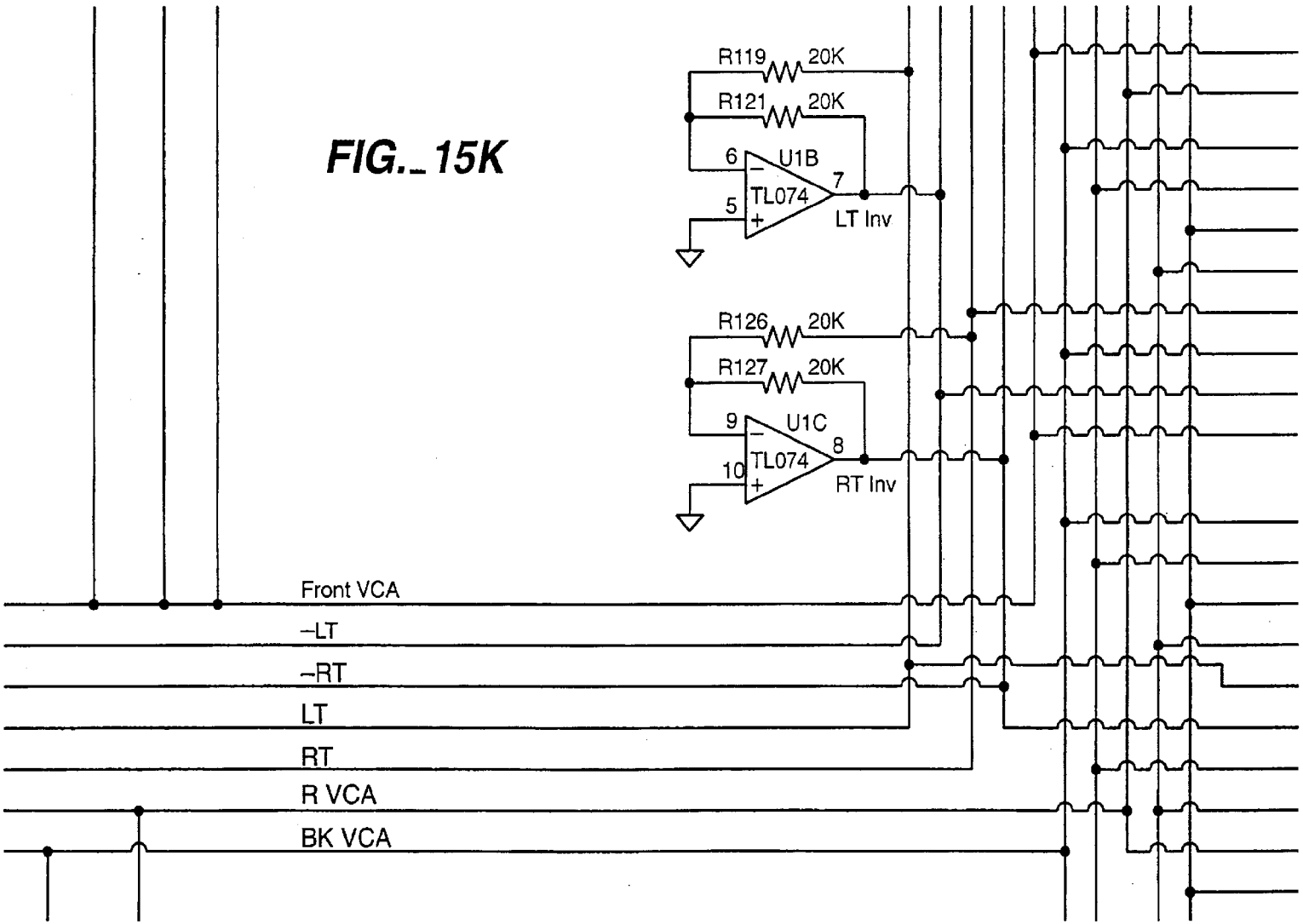
Figure 15L:
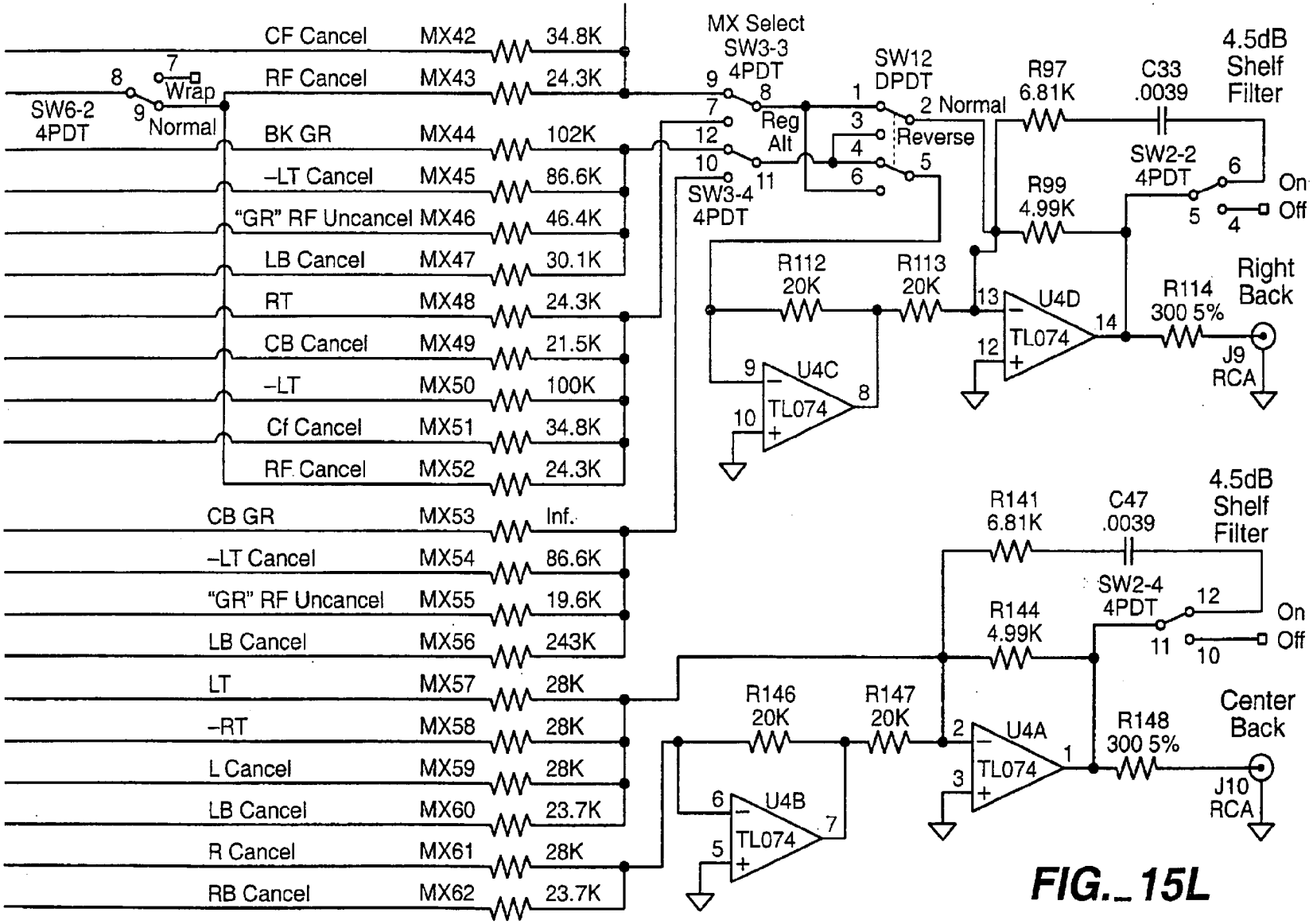
Figure 15M:
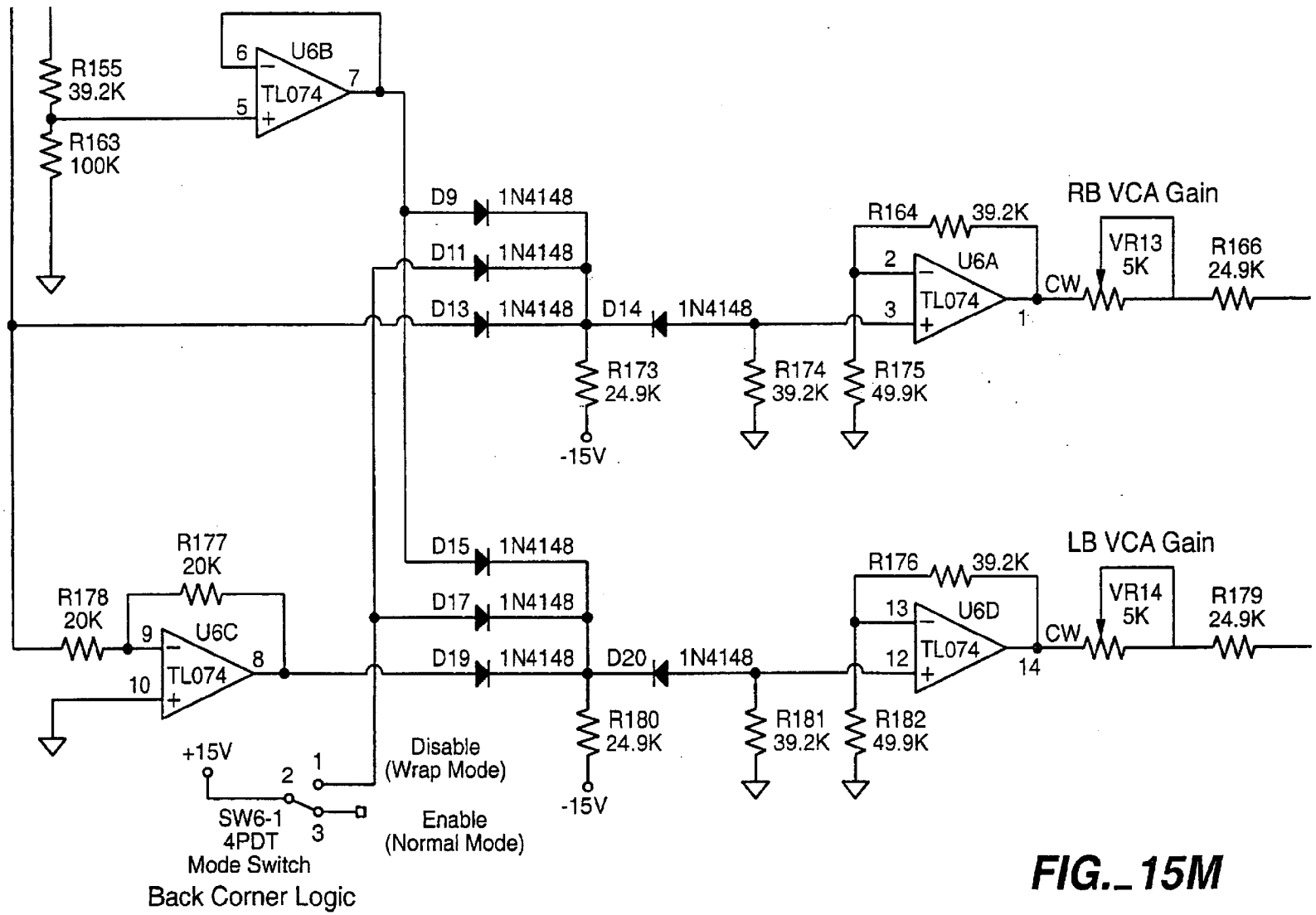
Figure 15N:
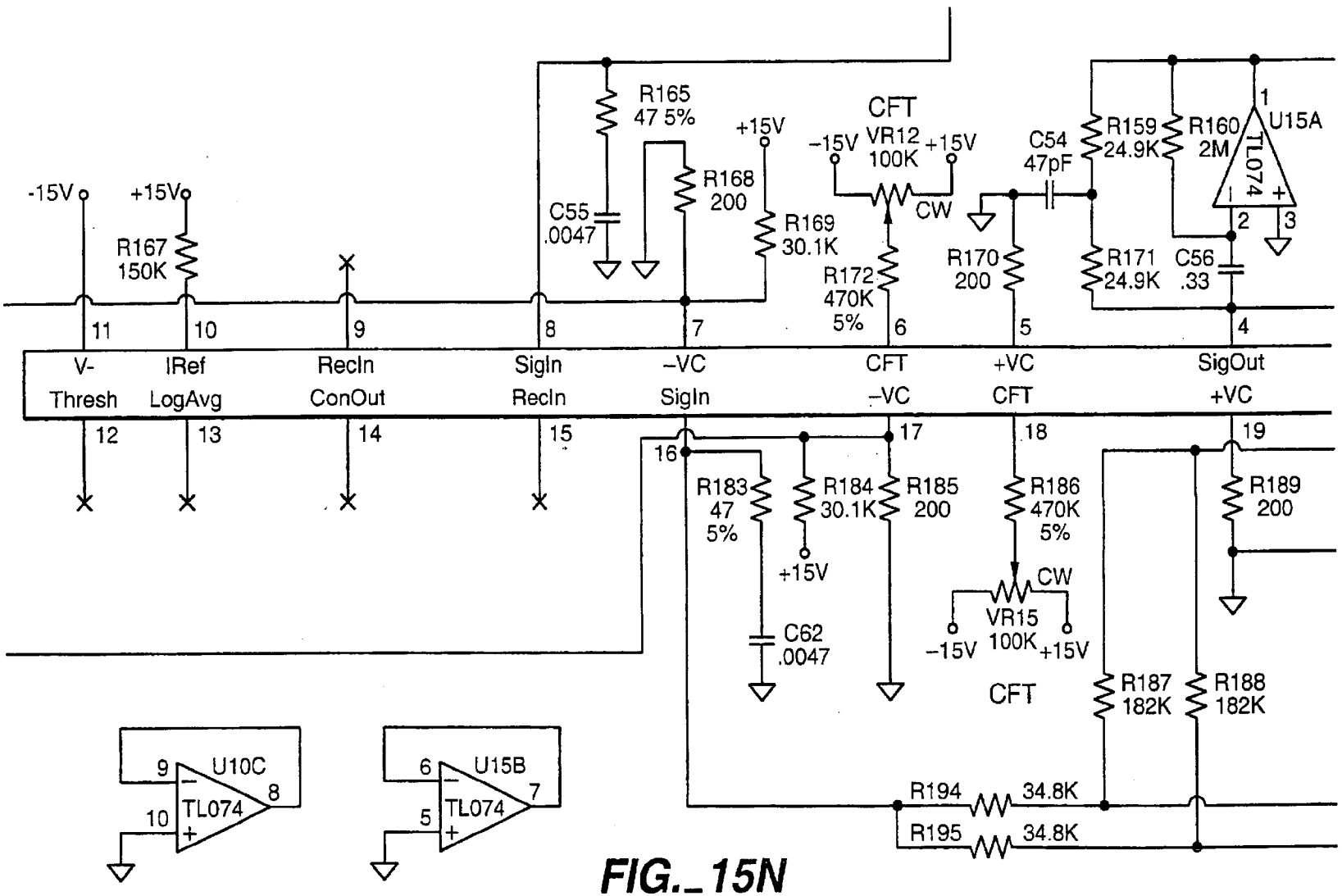
Figure 15O:
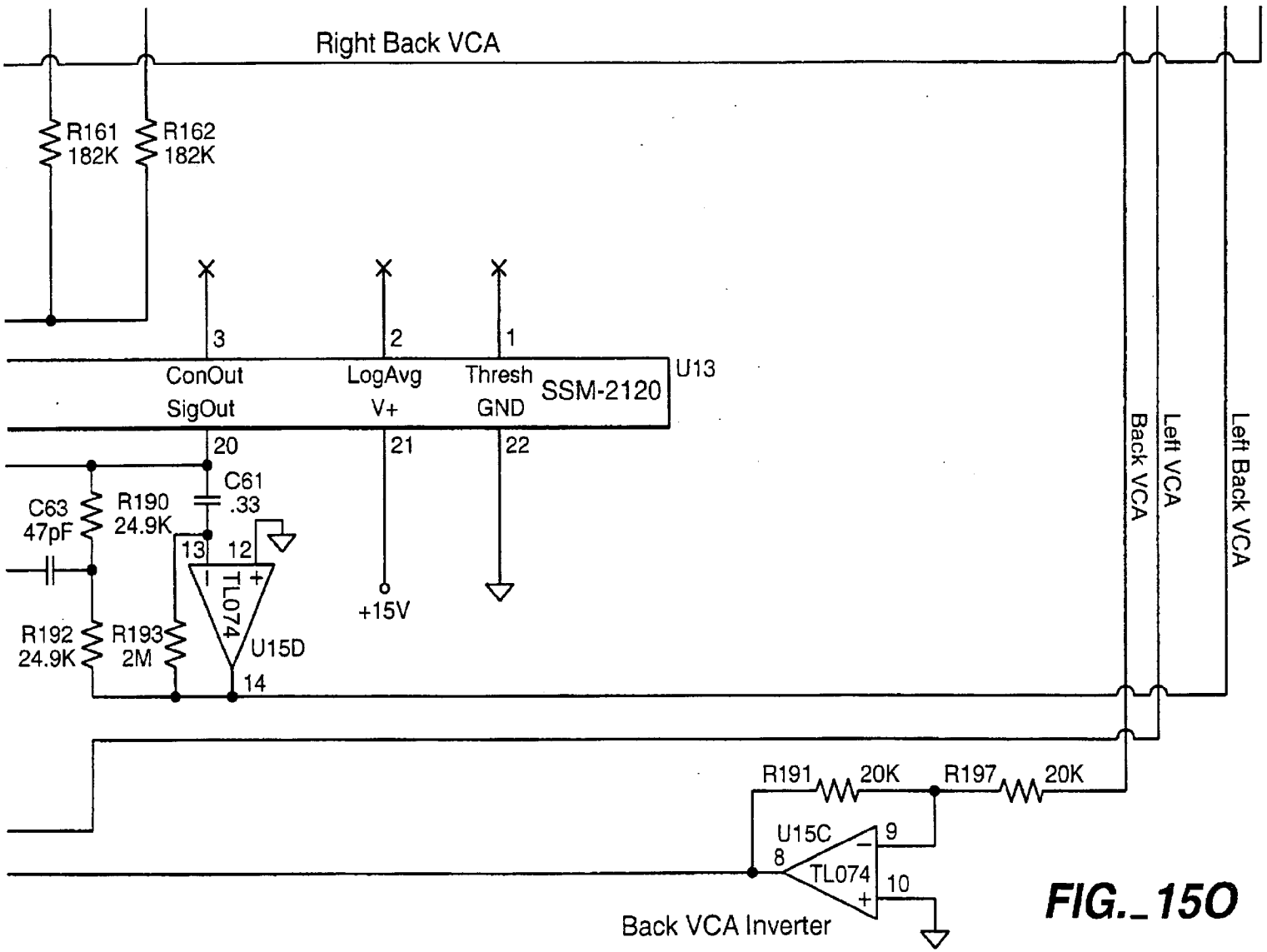
Figure 15P:
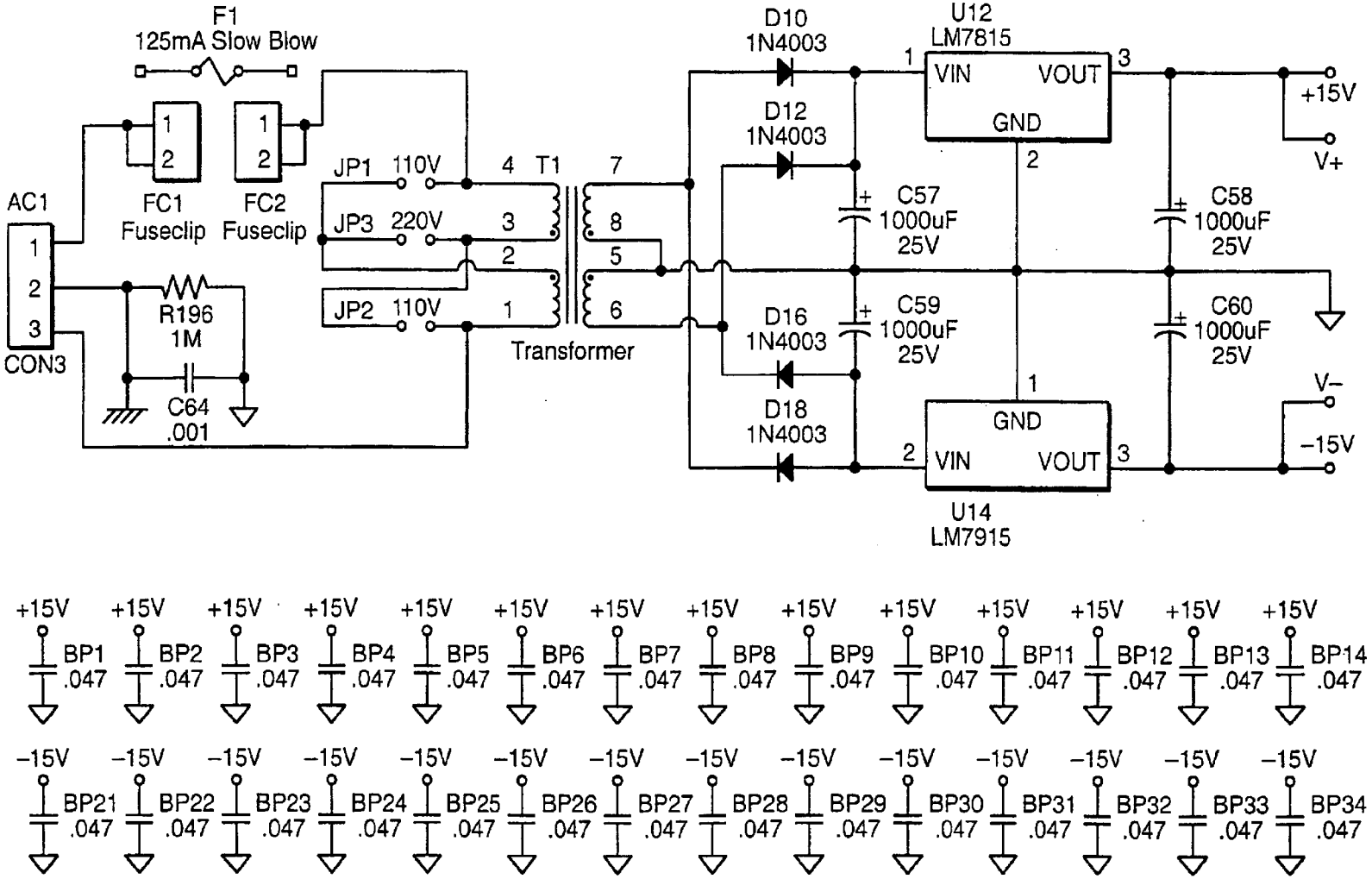

FIG. 15 is a schematic circuit diagram showing a practical circuit embodying aspects of the present invention. Resistor values shown are in ohms. Where not indicated, capacitor values are in microfarads.

In FIG. 15, "TL074" is a Texas Instruments' quad low-noise JFET-input (high input impedance) general purpose operational amplifier intended for high-fidelity and audio preamplifier applications. Details of the device are widely available in published literature. A data sheet may be found on the Internet at <<http://www.ti.com/sc/docs/products/analog/tl074.html>>.

"SSM-2120" in FIG. 15 is a monolithic integrated circuit intended for audio applications. It includes two VCAs and two level detectors, allowing logarithmic control of the gain or attenuation of signals presented to the level detectors depending on their magnitudes. Details of the device are widely available in published literature. A data sheet may be found on the Internet at <<http:/www.analog.com/pdf/1788_c.pdf>>.

The following table relates terms used in this document to the labels at the VCA outputs and to the labels on the vertical bus of FIG. 15.

| Terms used in the above description | Label at output of VCA of FIG. 15 | Label on vertical bus of FIG. 15 |
|---|---|---|
| $g_l*L_t$ | Left VCA | LVCA |
| $g_r*R_t$ | Right VCA | RVCA |
| $½*g_c*(L_t + R_t)$ | Front VCA | FVCA |
| $½*g_s*(L_t - R_t)$ | Back VCA | BVCA |
| $g_{lb}*((g_l*L_t + g_s*½*(L_t - R_t))$ | Left Back VCA | LBVCA |
| $g_{rb}*((g_r*R_t - g_s*½*(L_t - R_t))$ | Right Back VCA | RBVCA |

In FIG. 15, the labels on the wires going to the output matrix resistors are intended to convey the functions of the signals, not their sources. Thus, for example, the top few wires leading to the left front output are as follows:

| Label in FIG. 15 | Meaning |
|---|---|
| LT | The contribution from the $L_t$ input |
| CF Cancel | The signal to cancel the unwanted output for a center front source |
| LB Cancel | The signal to cancel the unwanted output for a left back source |
| BK Cancel | The signal to cancel the unwanted output for a back source |
| RB Cancel | The signal to cancel the unwanted source for a right back source |
| LF GR | Left front gain riding—to make a pan across the front give a more constant loudness |

Note that in FIG. 15, whatever the polarity of the VCA terms, the matrix itself has provision for inversion of any terms (U2C, etc.). In addition, "servo" in FIG. 15 refers to the feedback derived control system as described herein.

The present invention may be implemented using analog, hybrid analog/digital and/or digital signal processing in which functions are performed in software and/or firrnware. Analog terms such as VCA, rectifier etc. are intended to include their digital equivalents. For example, in a digital embodiment, a VCA is realized by multiplication or division.

I claim:

1. Method for deriving at least three audio output signals from two input audio signals, comprising deriving four audio signals from said two input audio signals, wherein the four audio signals are derived with a passive matrix that produces two pairs of audio signals in response to two audio signals, a first pair of derived audio signals representing directions lying on a first axis and a second pair of derived audio signals representing directions lying on a second axis, said first and second axes being substantially mutually orthogonal to each other, processing each of said pairs of derived audio signals to produce respective first and second pairs of intermediate audio signals wherein the magnitudes of the relative amplitudes of the audio signals in each pair of intermediate audio signals are urged toward equality, producing a first output signal representing a first direction lying on the axis of the pair of derived audio signals from which the first pair of intermediate signals are produced, said first output signal being produced at least by combining, with the same polarity, at least a component of each of said second pair of intermediate audio signals, producing a second output signal representing a second direction lying on the axis of the pair of derived audio signals from which the first pair of intermediate signals are produced, said second output signal being produced at least by combining, with the opposite polarity, at least a component of each of said second pair of intermediate audio signals, producing a third output signal representing a first direction lying on the axis of the pair of derived audio signals from which the second pair of intermediate signals are produced, said third output signal being produced at least by combining, with the same polarity or the opposite polarity, at least a component of each of said first pair of intermediate audio signals, and, optionally, producing a fourth output signal representing a second direction lying on the axis of said pair of derived audio signals from which the second pair of intermediate signals are produced, said third output signal being produced at least by combining, with the opposite polarity, if the third output signal is produced by combining with the same polarity, or at least by combining with the same polarity, if the third output signal is produced by combining with the opposite polarity, at least a component of each of said first pair of intermediate audio signals.

2. The method of claim 1 wherein producing a first output signal includes combining a component of each of said second pair of intermediate audio signals with a passive matrix audio signal representing said first direction, said component constituting a cancellation signal opposing said passive matrix audio signal, producing a second output signal includes combining a component of each of said second pair of intermediate audio signals with a passive matrix audio signal representing said second direction, said component constituting a cancellation signal opposing said passive matrix audio signal, producing a third output signal includes combining a component of each of said first pair of intermediate audio signals with a passive matrix audio signal representing said third direction, said component constituting a cancellation signal opposing said passive matrix audio signal, and, optionally, producing a fourth output signal includes combining a component of each of said first pair of intermediate audio signals with a passive matrix audio signal representing said fourth direction, said component constituting a cancellation signal opposing said passive matrix audio signal.

3. The method of claim 2 wherein the matrix audio signals representing said first, second, third and, optionally, fourth directions, respectively, are produced by said passive matrix.

4. The method of claim 2 wherein the passive matrix audio signals representing said first, second, third and fourth directions, respectively, are produced in a plurality of linear combiners that also combine the passive matrix audio signals with ones of said components of signals.

5. The method of claim 1 wherein the respective output signals are produced by combining said pairs of intermediate signals.

6. The method of any one of claim 1, 2 or 5 wherein said processing includes feeding back each pair of intermediate audio signals for use in controlling the relative amplitudes of the respective pair of intermediate audio signals.

7. The method of claim 6 wherein said processing includes applying each derived audio signal to a respective variable gain circuit, wherein the gain of each variable gain circuit associated with each pair of derived audio signals is controlled in response to the amplitudes of the outputs of the variable gain circuits in the respective pair.

8. The method of claim 7 wherein each variable gain circuit includes a voltage controlled amplifier (VCA), having a gain g, in combination with a subtractive combiner, the resulting variable-gain-circuit gain is (1-g), and said cancellation signals are taken from the outputs of said voltage controlled amplifiers.

9. The method of claim 7 wherein each variable gain circuit comprises a voltage controlled amplifier (VCA), having a gain g, the resulting variable-gain-circuit gain is g, and said cancellation signals are taken from the outputs of said voltage controlled amplifiers.

10. The method of claim 7 wherein the gain of each variable gain circuit is low for quiescent input signal conditions, such that said signal outputs are substantially the signals produced by said passive matrix.

11. The method of claim 7 wherein the gain of each variable gain circuit is high for quiescent input signal conditions, such that said signal outputs are substantially the signals produced by said passive matrix.

12. The method of claim 7 wherein the gains of the variable gain circuits associated with each pair of derived audio signals are controlled by applying the outputs of the respective variable gain circuits in the pair to a magnitude comparator that generates a control signal that controls the gains of the variable gain circuits.

13. The method of claim 12 wherein the respective magnitude comparators control the gains of the variable gain circuits associated with the pairs of derived audio signals such that, for some input signal conditions, an increase in the magnitude of the output of one variable gain circuit with respect to the other causes a decrease in the gain of the variable gain circuit having the increased output.

14. The method of claim 13 wherein the respective magnitude comparators control the gains of the variable gain circuits associated with the pairs of derived audio signals such that, for some input signal conditions, an increase in the magnitude of the output of one variable gain circuit with respect to the other also causes substantially no change in the gain of the variable gain circuit not having the increased output.

15. The method of claim 13 wherein the respective magnitude comparators control the gains of the variable gain circuits associated with the pairs of derived audio signals such that, for some input signal conditions, an increase in the magnitude of the output of one variable gain circuit with respect to the other also causes the product of the gains of the variable gain circuits to be substantially constant.

16. The method of claim 12 wherein the respective magnitude comparators control the gains of the variable gain circuits associated with the pairs of derived audio signals such that, for some input signal conditions, an increase in the magnitude of the output of one variable gain circuit with respect to the other causes an increase in the gain of the variable gain circuit having the increased output.

17. The method of claim 16 wherein the respective magnitude comparators control the gains of the variable gain circuits associated with the pairs of derived audio signals such that, for some input signal conditions, an increase in the magnitude of the output of one variable gain circuit with respect to the other also causes substantially no change in the gain of the variable gain circuit not having the increased output.

18. The method of claim 16 wherein the respective magnitude comparators control the gains of the variable gain circuits associated with the pairs of derived audio signals such that, for some input signal conditions, an increase in the magnitude of the output of one variable gain circuit with respect to the other also causes the product of the gains of the variable gain circuits to be substantially constant.

19. The method of claim 12 wherein the gain of said variable gain circuits in dB are linear functions of their control voltages, each magnitude comparator has finite gain and the output of each variable gain circuit is applied to a magnitude comparator via a rectifier that delivers an output signal proportional to the logarithm of its input.

20. The method of claim 19 wherein each rectifier is preceded by a filter having a response that attenuates low frequencies and very high frequencies and provides a gently rising response over the middle of the audible range.

21. The method of claim 12 further comprising deriving one or more additional control signals from the two control signals that control the variable gain circuits associated with each pair of passive matrix audio signals, wherein said one or more additional control signals are each derived by modifying one or both control signals and generating the lesser or greater of a unmodified control signal and a modified control signal or of two modified control signals.

22. The method of claim 21 wherein one or both of said control signals are modified by polarity inverting, amplitude offsetting, amplitude scaling and/or non-linearly processing the respective signal.

23. The method of claim 21 further comprising one or more additional variable gain circuits receiving as an input the combination of two of said plurality of cancellation signals or the combination of two passive matrix signals, wherein said one or more additional control signals control respective ones of said one or more additional variable gain circuits such that the circuit's gain rises to a maximum when said input signals represent a direction other than the directions lying on said first and second axes, and generating one or more additional cancellation signals by controlling said one or more additional variable gain circuits with a respective one of said one or more additional control signals.

24. The method of claim 23 wherein at least five output signals are produced by combining each of at least five passive matrix audio signals with two or more of said plurality of cancellation signals and said one or more additional cancellation signals, the cancellation signals opposing each passive matrix audio signal such that the passive matrix audio signal is substantially cancelled by the cancellation signals when said input audio signals represent signals associated with directions other than the direction represented by the passive matrix audio signal.

25. The method of claim 12 wherein the magnitude of the audio signals in a first pair of intermediate audio signals may be represented by the magnitude of $[(L_t+R_t)*(1-g_c)]$, or, equivalently the magnitude of $[(L_t+R_t)*(h_c)]$, and the magnitude of $[(L_t-R_t)*(1-g_s)]$, or equivalently, the magnitude of $[(L_t-R_t)*(h_s)]$, and the magnitude of the audio signals in the other pair of intermediate audio signals may be represented by the magnitude of $[L_t*(1-g_l)]$, or, equivalently, the magnitude of $[L_t*(h_l)]$, and the magnitude of $[R_t*(1-g_r)]$, or, equivalently, the magnitude of $[R_t*(h_r)]$, where $L_t$ and $R_t$ are one pair of audio signals produced by said passive matrix, $L_t+R_t$ and $L_t-R_t$ are the other pair of audio signals produced by said passive matrix, $(1-g_c)$ and $h_c$ are the gain of a variable gain circuit associated with the $L_t+R_t$ output of the passive matrix, $(1-g_s)$ and $h_s$ are the gain of a variable gain circuit associated with the $L_t-R_t$ output of the passive matrix, $(1-g_l)$ and $h_l$ are the gain of a variable gain circuit associated with the $L_t$ output of the passive matrix, and $(1-g_r)$ and $h_r$ are the gain of a variable gain circuit associated with the $R_t$ output of the passive matrix.

26. A method for deriving at least three audio signals, each associated with a direction, from two input audio signals, comprising generating with a passive matrix in response to said two input audio signals a plurality of passive matrix signals including two pairs of passive matrix audio signals, a first pair of passive matrix audio signals representing directions lying on a first axis and a second pair of passive matrix audio signals representing directions lying on a second axis, said first and second axes being substantially mutually orthogonal to each other, processing each of said pairs of passive matrix audio signals to produce respective first and second pairs of intermediate audio signals such that the magnitudes of the relative amplitudes of the audio signals in each pair of intermediate audio signals are urged toward equality, deriving a plurality of cancellation signals from said pairs of intermediate audio signals, producing at least three output signals by combining each of at least three passive matrix audio signals with two or more of said plurality of cancellation signals, the cancellation signals opposing each passive matrix audio signal such that the passive matrix audio signal is substantially cancelled by the cancellation signals when said input audio signals represent signals associated with directions other than the direction represented by the passive matrix audio signal.

27. The method of claim 26 wherein said processing includes feeding back each pair of intermediate audio signals for use in controlling the relative amplitudes of the respective pair of intermediate audio signals.

28. The method of claim 27 wherein said processing includes applying each passive matrix signal in said two pairs of passive matrix audio signals to a respective variable gain circuit, each circuit including a voltage controlled amplifier (VCA), having a gain g, in combination with a subtractive combiner, wherein the resulting variable-gain-circuit gain is 1-g) and said cancellation signals are taken from the outputs of said voltage controlled amplifiers.

29. The method of claim 28 wherein the gains of the variable gain circuits associated with each pair of passive matrix audio signals are controlled by applying the outputs of the respective variable gain circuits of each pair to a magnitude comparator that generates a control signal that controls the gains of the variable gain circuits.

30. The method of claim 29 wherein the outputs of the respective variable gain circuit of each pair are applied to a magnitude comparator via a rectifier, the rectifiers deliver signals proportional to the logarithm of their inputs, the comparator has finite gain, and the VCA gains in dB are linear functions of their control voltages.

31. The method of claim 29 further comprising deriving one or more additional control signals from the two control signals that control the variable gain circuits associated with each pair of passive matrix audio signals, wherein said one or more additional control signals are each derived by modifying one or both control signals and generating the lesser or greater of a unmodified control signal and a modified control signal or of two modified control signals.

32. The method of claim 31 wherein one or both of said control signals are modified by polarity inverting, amplitude offsetting, amplitude scaling and/or non-linearly processing the respective signal.

33. The method of claim 31 further comprising one or more additional variable gain circuits receiving as an input the combination of two of said plurality of cancellation signals or the combination of two passive matrix signals, wherein said one or more additional control signals control respective ones of said one or more additional variable gain circuits such that the circuit's gain rises to a maximum when said input signals represent a direction other than the directions lying on said first and second axes, and generating one or more additional cancellation signals by controlling said one or more additional variable gain circuits with a respective one of said one or more additional control signals.

34. The method of claim 33 wherein at least five output signals are produced by combining each of at least five passive matrix audio signals with two or more of said plurality of cancellation signals and said one or more additional cancellation signals, the cancellation signals opposing each passive matrix audio signal such that the passive matrix audio signal is substantially cancelled by the cancellation signals when said input audio signals represent signals associated with directions other than the direction represented by the passive matrix audio signal.

* * * * *